US012551777B1

(12) United States Patent
Curley

(10) Patent No.: US 12,551,777 B1
(45) Date of Patent: Feb. 17, 2026

(54) APPARATUS FOR MODIFIED POKER

(71) Applicant: Charles M Curley, Cortland, NY (US)

(72) Inventor: Charles M Curley, Cortland, NY (US)

( * ) Notice: Subject to any disclaimer, the term of this patent is extended or adjusted under 35 U.S.C. 154(b) by 0 days.

(21) Appl. No.: 19/220,462

(22) Filed: May 28, 2025

(51) Int. Cl.
*A63F 1/12* (2006.01)
*A63F 1/00* (2006.01)
*A63F 1/14* (2006.01)

(52) U.S. Cl.
CPC ..... *A63F 1/12* (2013.01); *A63F 1/14* (2013.01); *A63F 2001/005* (2013.01)

(58) Field of Classification Search
CPC ..... A63F 1/12; A63F 1/14
See application file for complete search history.

(56) References Cited

U.S. PATENT DOCUMENTS

| | | | |
|---|---|---|---|
| 1,885,276 | A | 11/1932 | McKay |
| 2,026,682 | A | 1/1936 | Jeffries |
| 3,260,520 | A | 7/1966 | Sugden |
| 3,771,783 | A | 11/1973 | McInerny |
| 4,586,712 | A | 5/1986 | Lorber |
| 4,659,082 | A | 4/1987 | Greenberg |
| 4,770,421 | A | 9/1988 | Hoffman |
| 5,989,122 | A | 11/1999 | Roblejo |
| 6,149,154 | A | 11/2000 | Grauzer |
| 6,267,248 | B1 | 7/2001 | Johnson |
| 6,659,460 | B2 | 12/2003 | Blaha |
| 7,261,294 | B2 | 8/2007 | Grauzer |
| 7,338,044 | B2 | 3/2008 | Grauzer |
| 7,500,672 | B2 | 3/2009 | Ho |
| 7,753,374 | B2 | 7/2010 | Ho |
| 7,766,333 | B1 | 8/2010 | Stardust |
| 7,900,923 | B2 | 3/2011 | Toyama |
| 7,900,924 | B2 | 3/2011 | Ho |
| 8,267,404 | B2 | 9/2012 | Grauzer |
| 8,342,525 | B2 | 1/2013 | Scheper |
| 8,342,526 | B1 | 1/2013 | Sampson |
| 8,353,513 | B2 | 1/2013 | Swanson |
| 8,419,016 | B2 | 4/2013 | Yoseloff |
| 8,544,848 | B2 | 10/2013 | Blaha |
| 8,590,896 | B2 | 11/2013 | Krenn |
| 8,651,486 | B2 | 2/2014 | Grauzer |
| 8,702,100 | B2 | 4/2014 | Snow |
| 8,931,779 | B2 | 1/2015 | Grauzer |
| 9,126,103 | B2 | 9/2015 | Krenn |

(Continued)

*Primary Examiner* — Michael D Dennis
(74) *Attorney, Agent, or Firm* — Chris Tanner; FYPA PLLC

(57) ABSTRACT

A card handling apparatus creates pre-formed hands for use in poker games and may be programmed to accommodate a number of different game variations and players. An unshuffled card input portal and a shuffled card discharge portal each have two output trays, each discharging play-ready hands. Two play-ready hands are simultaneously discharged face down to each of the output trays at the initiation of a game. A first player can choose to receive his/her hand from either tray, where each vacant tray is immediately replenished such that the next player has a choice of receiving their hand from either tray. In one embodiment the apparatus randomly assigns one of the trays as the source for each player's hand, in another embodiment the cards are discharged to the output trays in a face-up orientation. The apparatus also has a rapid purge mode which quickly clears residual cards.

23 Claims, 15 Drawing Sheets

(56) References Cited

U.S. PATENT DOCUMENTS

| | | | | |
|---|---|---|---|---|
| 9,138,635 | B1 * | 9/2015 | Sines | A63F 1/12 |
| 9,474,957 | B2 | 10/2016 | Haushalter | |
| 9,623,317 | B2 | 4/2017 | Scheper | |
| 9,717,979 | B2 | 8/2017 | Grauzer | |
| 10,226,686 | B2 | 3/2019 | Scheper | |
| 10,864,431 | B2 | 12/2020 | Stasson | |
| 11,376,489 | B2 | 7/2022 | Scheper | |
| 12,083,414 | B1 | 9/2024 | Curley | |
| 12,179,090 | B1 | 12/2024 | Curley | |
| 12,268,953 | B2 | 4/2025 | Curley | |
| 2009/0302535 | A1 * | 12/2009 | Ho | A63F 1/12 273/149 R |
| 2013/0020761 | A1 | 1/2013 | Sines | |
| 2015/0238848 | A1 * | 8/2015 | Kuhn | A63F 1/12 273/149 R |
| 2024/0009547 | A1 | 1/2024 | Oeding | |
| 2025/0032894 | A1 | 1/2025 | Krenn | |
| 2025/0050200 | A1 | 2/2025 | Curley | |

* cited by examiner

FIG. 12
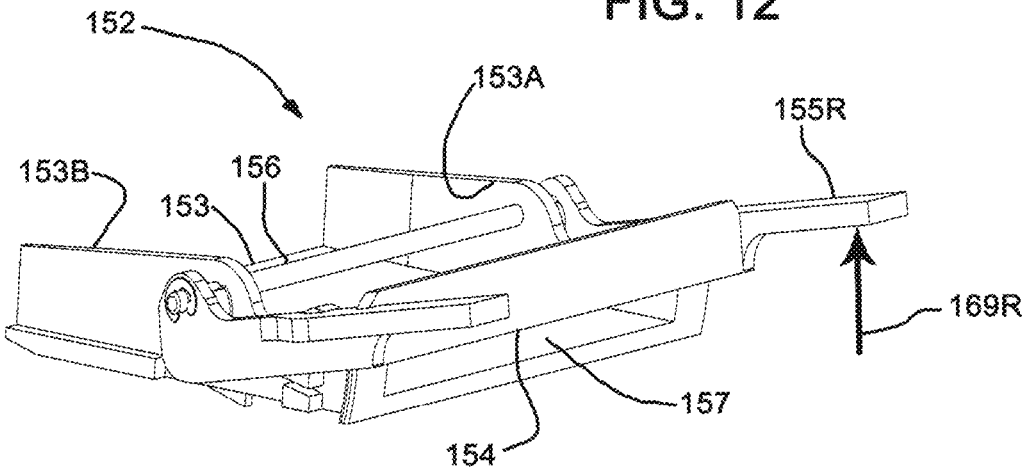
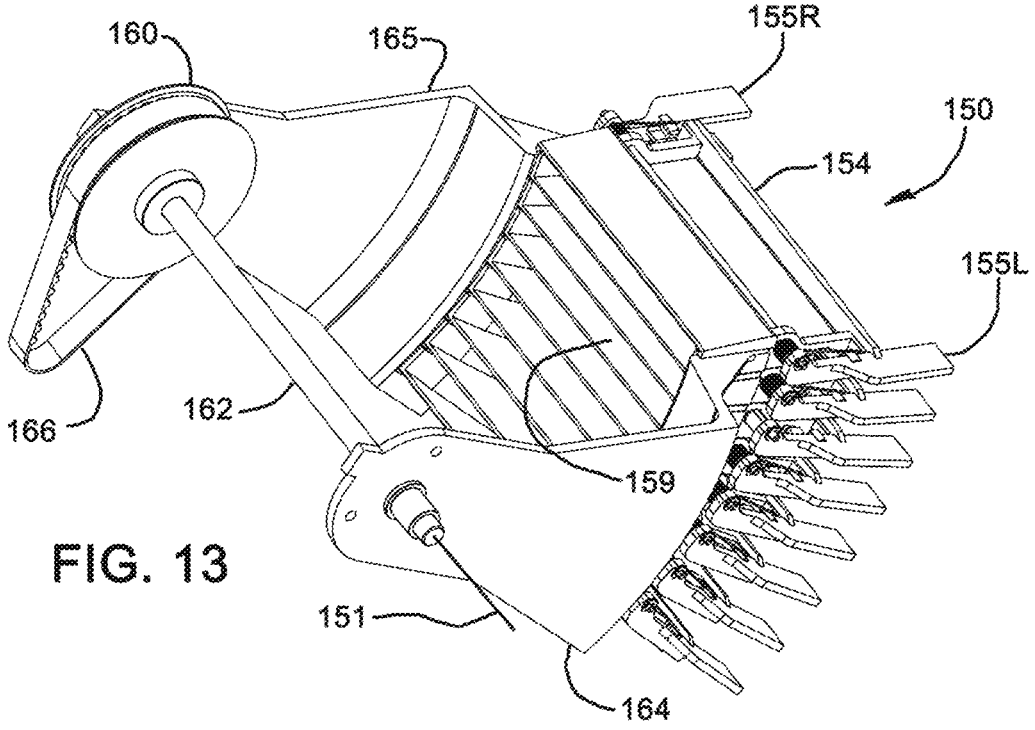
FIG. 13

FIG. 15A
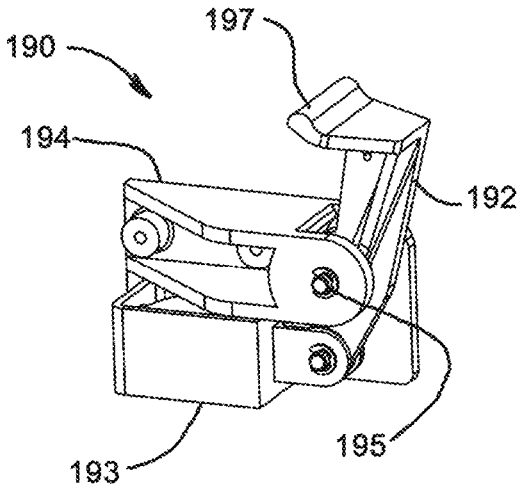
FIG. 15B
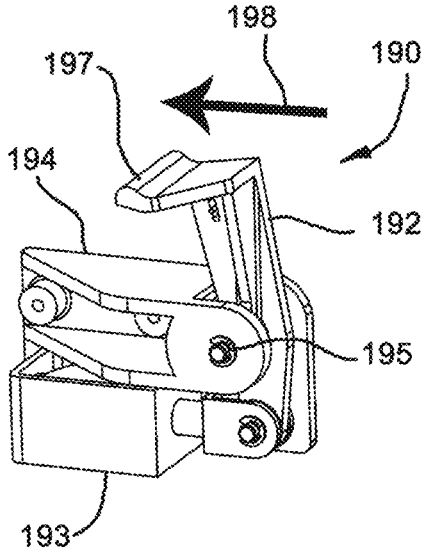
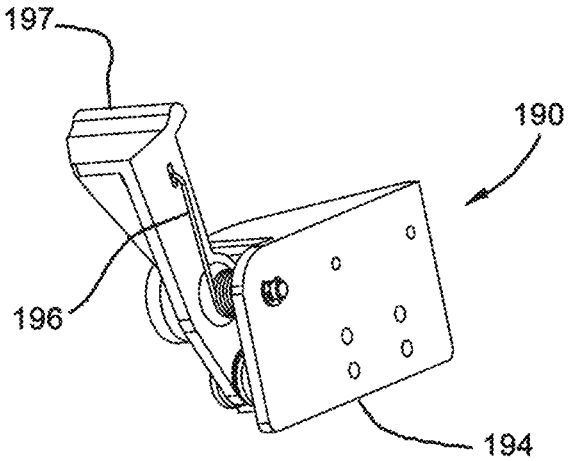
FIG. 15C

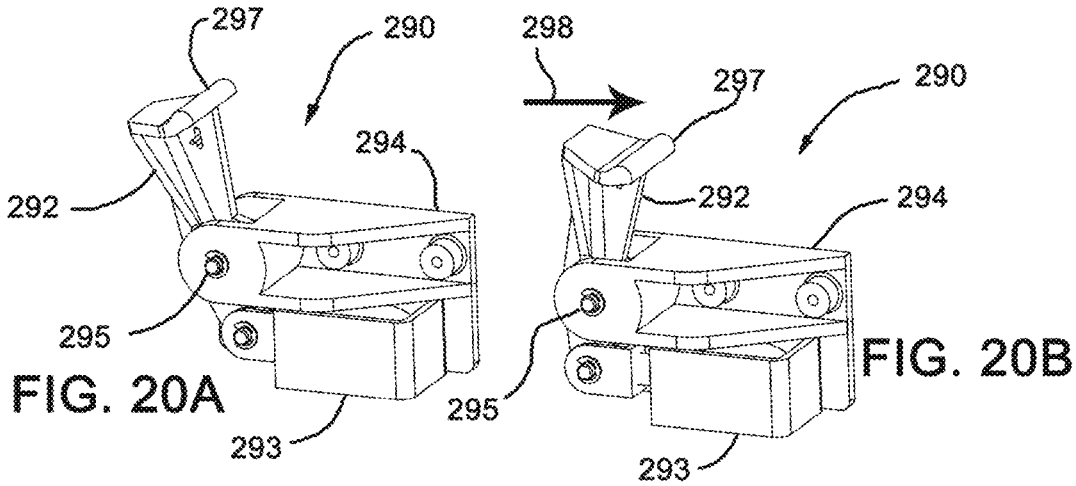
FIG. 20A
FIG. 20B
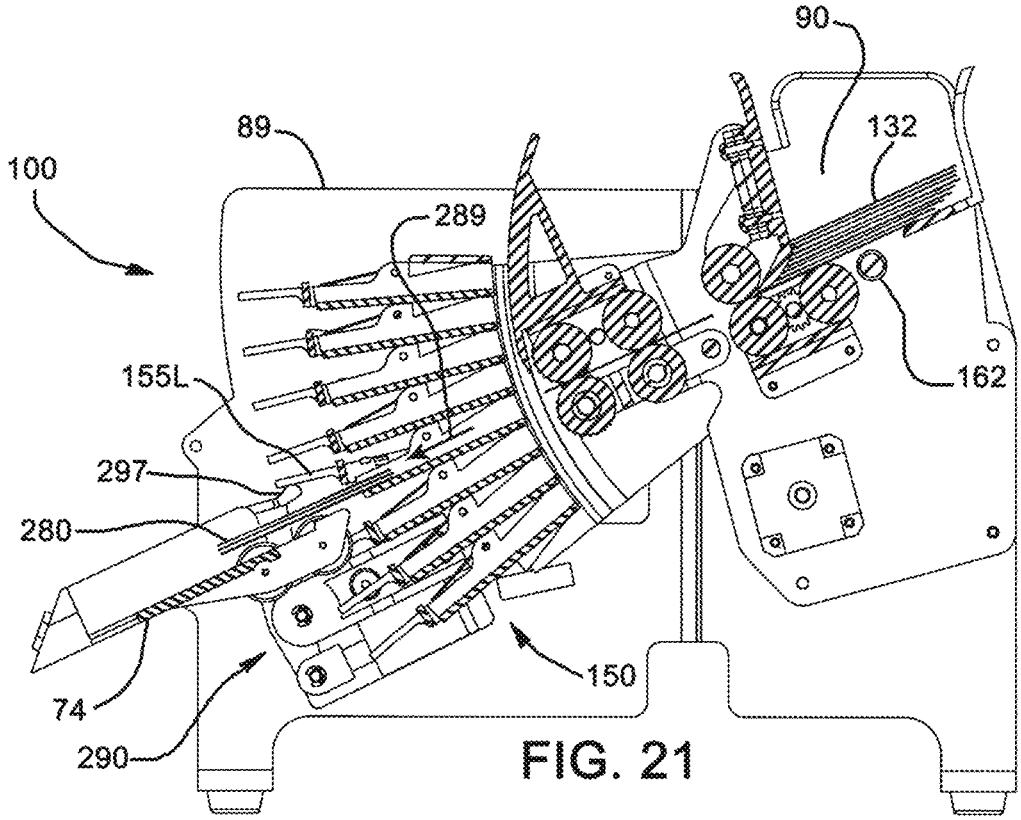
FIG. 21

APPARATUS FOR MODIFIED POKER

FIELD OF INVENTION

The present invention is related to the field of casino grade automatic card shuffling machines, which are used by casinos to speed up the rate of play of dealer-hosted card games. More particularly, the invention relates to shuffling machines which randomize the rank and suit of cards within a single deck of playing cards in order to form "hands" for use in various types of poker games. These shuffler types are called "hand forming" shufflers in the art because they dispense groups of play-ready cards to an exit portal, whereupon a casino dealer issues one shuffled hand to each player at the initiation of a poker game. The group of play-ready cards which constitute a hand are herein referred to as a "play-ready substack".

BACKGROUND

Stud poker games such as Mississippi Stud Poker, Three-Card Poker®, or Caribbean Stud® are major attractions in casino poker rooms because they are relatively easy to play and allow wagering to various degrees of risk. A single deck of 52 playing cards is used in these games, which must be periodically shuffled to effect randomness of the rank and suit of the individual cards within the deck. Each poker game is initiated by delivering a shuffled (randomized) hand of playing cards to each game participant. It is to the advantage of the casino to reduce the time that a dealer handles and shuffles playing cards between games, thereby increasing revenues. Casinos thus use automatic shuffling machines to speed up the rate of play at gaming tables, retaining the interest of the players and sustaining the rate of play.

Conventional "hand-forming" shufflers quickly randomize card decks and sort them into shuffled substacks within compartments which reside within the apparatus. Upon dealer request, each play-ready substack is delivered from a compartment to an exit portal where a dealer may issue that hand to a player or themself. The hand-forming shufflers are programmable such that the number of cards in each substack may be adjusted for individual card games, and for the number of players. For example, various forms of five-card stud poker will be initiated with hands of 5 cards, while games such as Three-Card Poker® are played with hands of only three cards. In some poker games where participants play against a dealer, the dealer may receive a different number of cards. For example, in 4-Card Poker, each player receives play-ready hands (substacks) of 5 cards while the dealer receives a 6-card hand.

FIG. 1 illustrates an early "hand-forming" playing card shuffler that was described in a 1932 patent granted to R. C. McKay and issued as U.S. Pat. No. 1,885,276 (McKay '276). Groups of individual playing cards are accumulated into substacks in four compartments which are configured radially in a rotating carrier. FIG. 1 is reproduced from the McKay '276 patent which explains that individual cards are separated from an unshuffled deck and randomly accumulated into four compartments. The substacks of cards are retained in each compartmental nest by gravity, and the substacks must be removed from their nests by displacing the card carrier so that the cards may be removed in the same direction from which they were inserted.

Referring to FIG. 1, the rotational housing which carries the four compartments is called the "receiver" 1024, which possesses four compartments 1025 thru 1028 for accumulating substacks of randomly selected cards. The receiver 1024 rotates about pivot 1032 to one of four randomly chosen radial positions. A deck of cards is placed into the magazine 1001 which utilizes rubber tired wheels 1003 to strip individual cards from the bottom of the stack and move them through a slotted opening 1050 under the power of a hand crank. An innovative random selection mechanism using small balls of four sizes is used to randomly position the receiver 1024 to one of four radial positions for collecting the individual cards into compartments 1025 thru 1028.

McKay '276 appears to have pioneered the concept of "shuffling" cards by distributing individual cards randomly into a myriad of compartments. Indeed, the 1932 patent is entitled AUTOMATIC CARD SHUFFLER AND DEALER, and teaches an innovative randomizing configuration which was implemented without the aid of motors or microcontrollers.

A later shuffler patent is known in the industry as the "Lorber Design" and was taught by U.S. Pat. No. 4,586,712 (Lorber '712), which was granted in 1986. This classic configuration (shown in FIG. 2) is based upon unloading cards from an unshuffled deck into the individual slots of a carousel, randomly rotating the carousel, and then pushing individual cards from the carousel slots and into a shoe. Each slot in the Lorber '712 carousel holds one card. As shown in the upper section of FIG. 2, an unshuffled card stack 2053 is deposited on edge into container 2052 of the automatic shuffling apparatus 2050. Individual cards are vertically stripped from the stack and moved downward from the left end of container 2052 and into a carousel 2062 by driven rollers 2054 and 2055. The carousel 2062 is described as a storage device 2060 which possesses a series of radially arranged addressable spaces 2064 which can be aligned with the edges of card stack 2053 of container 2052 for the purpose of inserting a card. A computer rotates a stepper motor (not shown) to insert cards in any random space within the carousel 2062. Individual cards are extracted from the randomly rotated carousel 2062 at the station shown in the bottom left section of the figure by the action of an "ejecting device" 2066. Driven rollers 2054 and 2055 move the individual cards into a newly created stack within the space 2068. The stack of cards within discharge portal 2068 has thus been arranged randomly (shuffled).

Rather than arranging the card storage compartments within a circular carousel, other early shufflers utilized compartments configured in a vertical stack. 1988 U.S. Pat. No. 4,770,421 to Lionel Hoffman (Hoffman '421) teaches a stack of "mixing pockets". Referring to FIG. 3A, which is reproduced and annotated from that patent, the six mixing pockets 934A through 934F are arranged in a linear stack. The Hoffman '421 specification explains that cards are individually inserted into a randomly chosen compartment within the stack of mixing pockets, accumulated, and then extracted in groups from the mixing pockets in a random order. The specification explains;

> According to a more particular form of the invention, a card shuffler is provided comprising a plurality of mixing pockets for holding cards, and card holding and distribution means for holding a stack of cards and for distributing and transferring one card at a time in sequence to said mixing pockets in accordance with a first distribution schedule. (Hoffman '421 1:61-67)

The compartment shuffler art has since generally evolved into myriads of disclosures that are characterized by their storage compartment configurations. A large group of more recent shuffler disclosures utilize linear stacks and elevators, and another large group of more recent disclosures utilize circularly-arranged storage exemplified by drums and carousels.

A more recent "hand-forming" shuffler is taught by U.S. Pat. No. 6,659,460 which was granted in 2003 to Ernst Blaha (Blaha '460), as shown in FIG. 3B. Blaha '460 also incorporates a carousel configuration which is similar to the Lorber design, but Blaha '460 differs from its predecessor by configuring the carousel slots to accumulate multiple cards. In this way, Blaha is used as a hand forming shuffler.

Referring to FIG. 3B, unshuffled cards 313 residing in an unshuffled card station 310 (upper left) are transported by feed rollers 314, 315, 318 and 319 into compartments 369 of the "rotatably held drum" 302. The rollers 318 and 319 are unable to fully insert the cards into the compartments, thus requiring a first pusher 316 which is driven by a motor 323 through eccentric link 322. The pusher 316 pushes each card through the final small movement into the compartments 369 of the drum 302. The drum is rotated by motor 308 to random loading positions as commanded by a microprocessor such that each compartment may accumulate a series of randomly selected cards.

The drum compartments are unloaded to a second station 342 by a second pusher linkage 335 and 337 which is actuated by a motor-driven eccentric 338. After each card is pushed sufficiently into the friction rollers 340 and 345, those rollers move the cards to the "card storage means" 342, as driven by motor 341. Blaha '460 uses two motors to insert each card into the drum, and another two motors to extract the substacks.

U.S. Pat. No. 6,149,154 was granted to Attila Grauzer et al in 2000 (Grauzer '154) and describes another "hand-forming" shuffler where the carousel compartments are unwound into the form of a linear elevator. The elevator consists of card accumulation compartments which are moved linearly rather than rotationally. FIG. 4 shows an illustration reproduced from the '154 patent showing the side view of the device, including the "hand receiving platform" 836, the "card moving mechanism" 830, the "rack assembly" 828, and the card receiver 826 "for receiving a group of cards for being formed into hands". Operation is understandingly similar to the carousel devices. Cards are randomly inserted into slots of the elevator at one station, and thereafter randomly pushed from slots at another station. Cards cannot be moved directly from the input portal to the discharge portal.

Referring to FIG. 4, Grauzer '154 teaches an elevator with nine compartments called a "rack assembly" which traverses up and down in direction of arrow 884. Unshuffled card decks are placed into the unshuffled card receiver 826 against the surface 870 of a moveable block 868, and individually propelled in direction of arrow 882 by motorized rollers 850, 862 and 864 into the compartments of the rack assembly 828 at the loading station 830. An elevator motor 842 and timing belt 840 move the rack assembly upwards and downwards to align randomly chosen compartments with arrow 882. Thereafter, each card is inserted into a randomly chosen compartment and temporarily accumulated with others. A microcontroller counts the number of cards inserted into each randomly chosen compartment. When a given compartment reaches the capacity of cards required for a hand, no more cards are entered into that compartment, and the compartment is considered ready for discharge.

When enough compartments are filled to the hand capacity needed for the number of players, the shuffler is then ready to disgorge substacks (hands). A pusher mechanism 890 is located at a lower station and used to push the substacks out of the compartments in the direction of arrow 886 and into the "hand receiving platform" 836. In comparison to the carousel shuffler designs, Grauzer '154 teaches that only eight (8) compartments are required for proper randomization in a hand forming shuffler.

In the Grauzer '154 configuration, the substacks are retained within each elevator compartment by gravity. Thus, a motorized "pusher mechanism" is needed for removing the substacks from the elevator compartments to the hand receiving platform 836. FIG. 5 is a reproduction from another figure of the Grauzer '154 patent that explains the card removal pusher mechanism in more detail. The elevator positions the compartment requiring extraction at a level occupied by a "pusher' mechanism as aligned with arrow 886. The substacks are thereafter pushed out of the compartment 892 allowing the substack to fall by gravity into the hand receiving platform 836. Grauzer '154 describes the pusher 890 as a "rack". The passage below paraphrases a section of the Grauzer disclosure where the label numerals are altered to the equivalent labels used herein.

> The pusher 890 includes a substantially rigid pusher arm in the form of a rack having a plurality of linearly arranged apertures along its length. The arm 890 operably engages the teeth of a pinion gear 896 driven by an unloading motor 898, which is in turn controlled by the microprocessor. At its leading or card contacting end, the pusher arm 890 includes a blunt, enlarged card-contacting end portion. ('154 12:56-67)

Grauzer '154 describes the well-known commercialized "hand forming" shuffler manufactured by ShuffleMaster, called the ACE Shuffler®. The elevator is referred to as a "rack assembly" in the disclosure and consists of eight "hand forming" compartments and a ninth oversized compartment for accumulating the unused cards which remain after all of the required hands have been formed. The oversized compartment is located centrally within the elevator and indicated by label 894 in FIG. 9. The disclosure explains that eight compartments are sufficient for statistical randomization of a deck (52 cards) in the following paraphrased passage.

> Preferably, the rack assembly 828 has nine compartments. Seven of the nine compartments are for forming player hands, one compartment forms dealer hands and the last compartment 894 is for accepting unused or discard cards. It should be understood that the device the present invention is not limited to rack assembly with seven compartments. For example, although it is possible to achieve a random distribution of cards delivered to eight compartments with a fifty-two card deck or group of cards, if the number of cards per initial unshuffled group is greater than 52, more compartments than nine may be provided to achieve sufficient randomness in eight formed hands. ('154 8:66-67, 9:1-10)

The oversized compartment 894 shown in FIG. 9 is required to collect the unused cards from the unshuffled card receiver. The unused cards must be temporarily stored in the rack assembly because there is no direct path from the unshuffled card receiver to the hand receiving platform. That problem is resolved by the apparatus being disclosed herein, which eliminates the need for an oversized ninth card storage compartment.

The commercial success of the ACE Shuffler® teaches that eight (8) compartments are needed for proper statistical randomization of a deck of 52 cards. Adding additional compartments to a poker room shuffler will therefore make such a device unnecessarily larger in size and impose longer excursions which penalize responsiveness. More compartments additionally prolong the time for purging a shuffler after each poker round. For example, some prior art devices with sixteen (16) compartments require twice the time for purging between poker rounds when compared to a device having eight (8) compartments.

The apparatus herein advantageously utilizes centrifugal force to retain and align the card substacks in eight (8) radially-arranged nests, thus eliminating the need for clamping devices and the motorized pusher mechanisms that are found in conventional hand-forming shufflers. Shorter card excursion paths and the lack of pusher cycles allows faster rotational excursions (higher acceleration) during the randomized distribution of cards from the input portal to the temporary storage nests. The device described herein also allows cards to be moved directly from the input portal to the output portal without requiring temporary storage within the radial nests, a feature which has multiple advantages.

When compared to other prior art compartment shufflers, the improved responsiveness, cost efficiency advantages and unique game variations possible with the apparatus described herein will become better understood with reference to the descriptions, drawings and claims which are presented below.

BRIEF DESCRIPTION OF THE DRAWINGS

FIG. 12 is another perspective view of the of the card substack nest of the preferred embodiment.

FIG. 13 is a perspective view of the radial receiver assembly of the preferred embodiment.

FIG. 15A is a perspective view of the first selector at rest.

FIG. 15B is a perspective view of the first selector when activated.

FIG. 15C is another perspective view of the first selector at rest.

FIG. 20A is an isolated perspective view of the second selector at rest.

FIG. 20B is an isolated perspective view of the second selector when activated.

FIG. 21 is a side elevation section view showing a card substack being launched into the second output tray.

DETAILED DESCRIPTION

Figure 1:
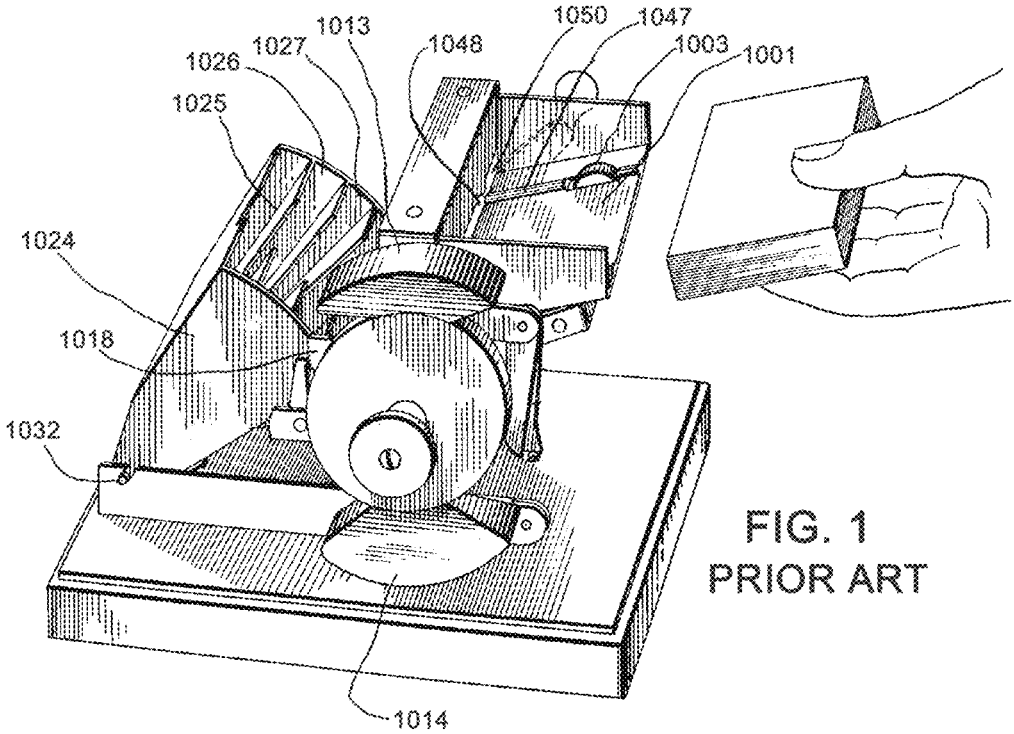
FIG. 1 PRIOR ART
FIG. 1 is a perspective view from an early (1932) hand-forming shuffler patent.
Figure 2:
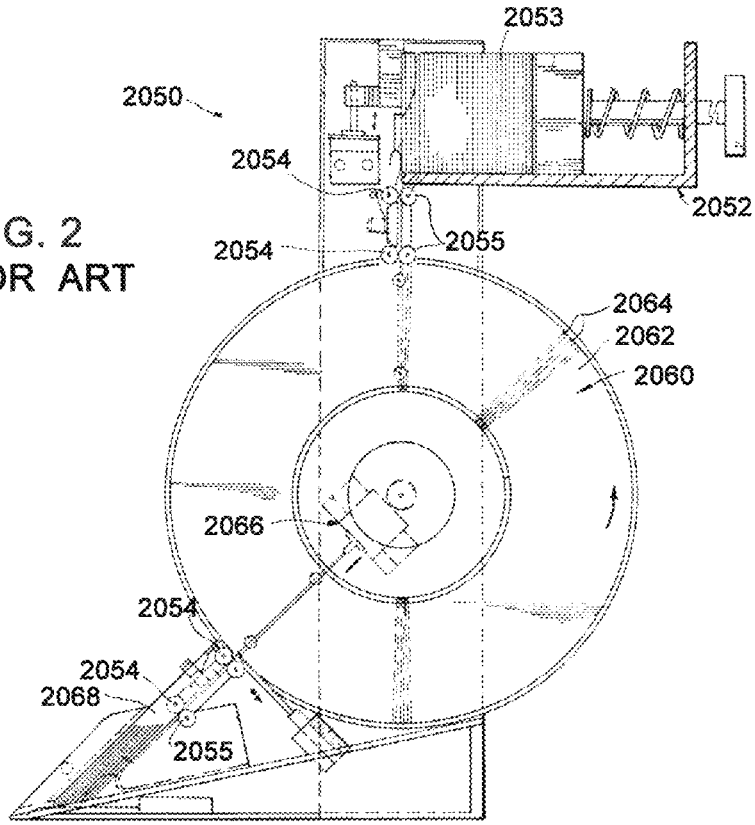
FIG. 2 PRIOR ART
FIG. 2 is side elevation view from a prior art (1986) carousel shuffler patent disclosure.
Figure 3A:
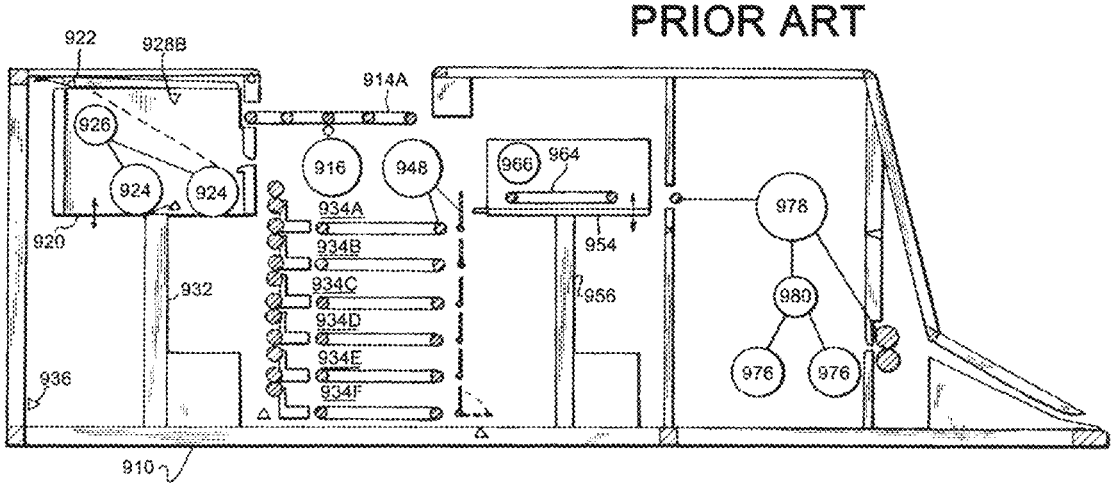
FIG. 3A PRIOR ART
FIG. 3A is a side elevation view from a prior art (1988) elevator shuffler patent disclosure.
Figure 3B:
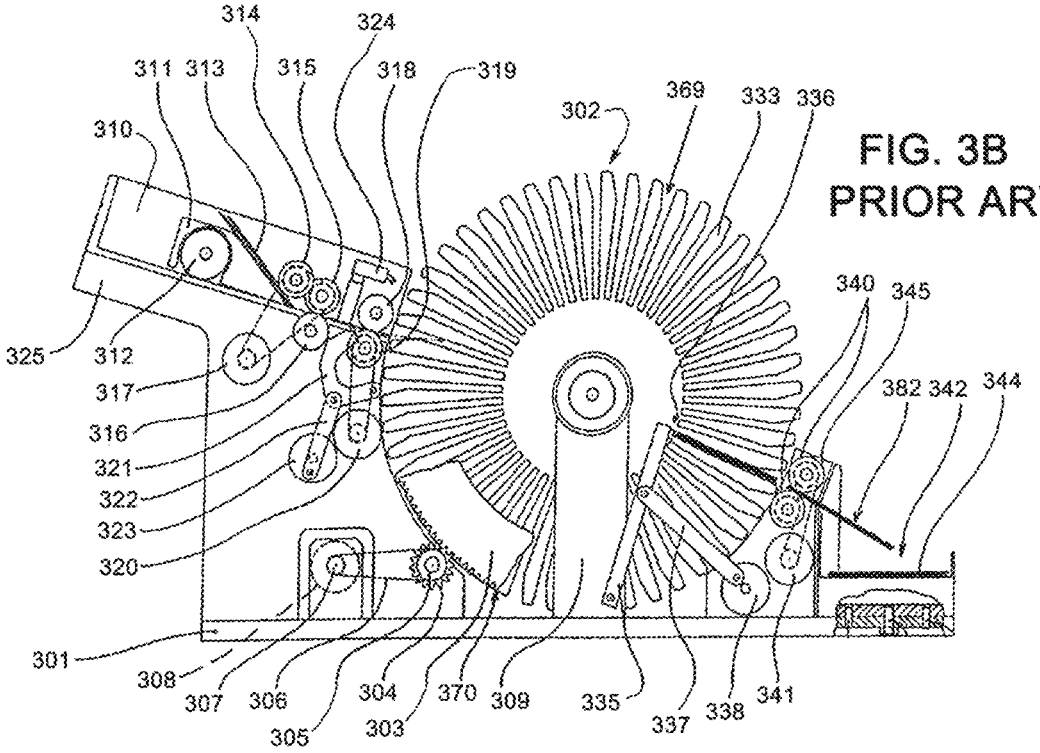
FIG. 3B PRIOR ART
FIG. 3B is a side elevation view from a prior art (2003) carousel shuffler patent disclosure.
Figure 4:
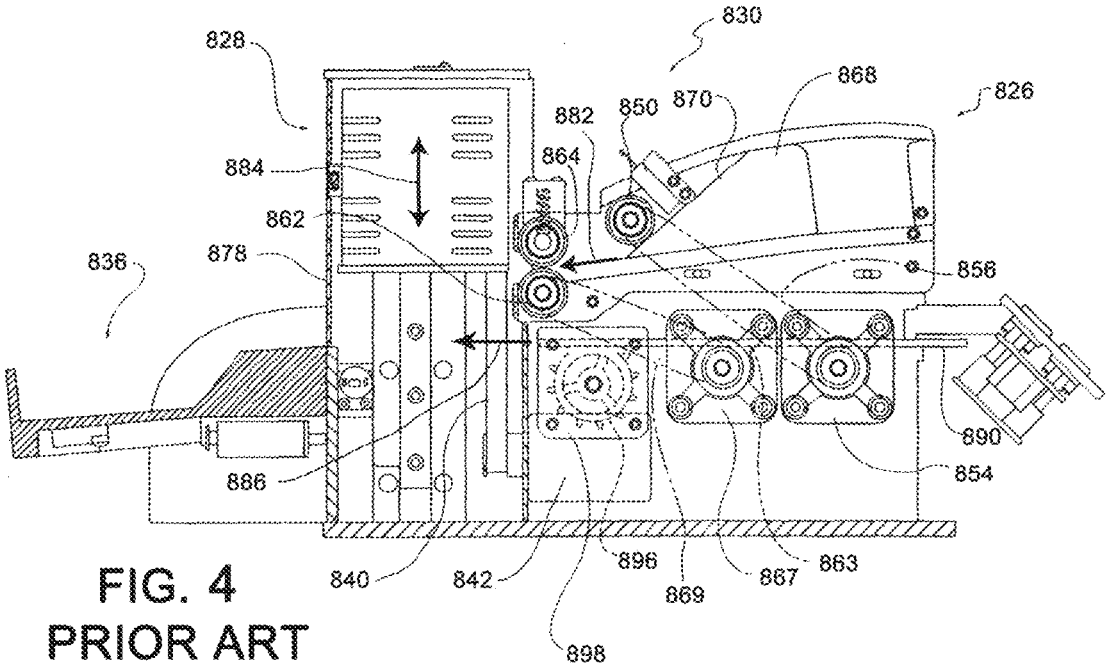
FIG. 4 PRIOR ART
FIG. 4 is a side elevation view from a prior art (2000) elevator shuffler patent disclosure.
Figure 5:
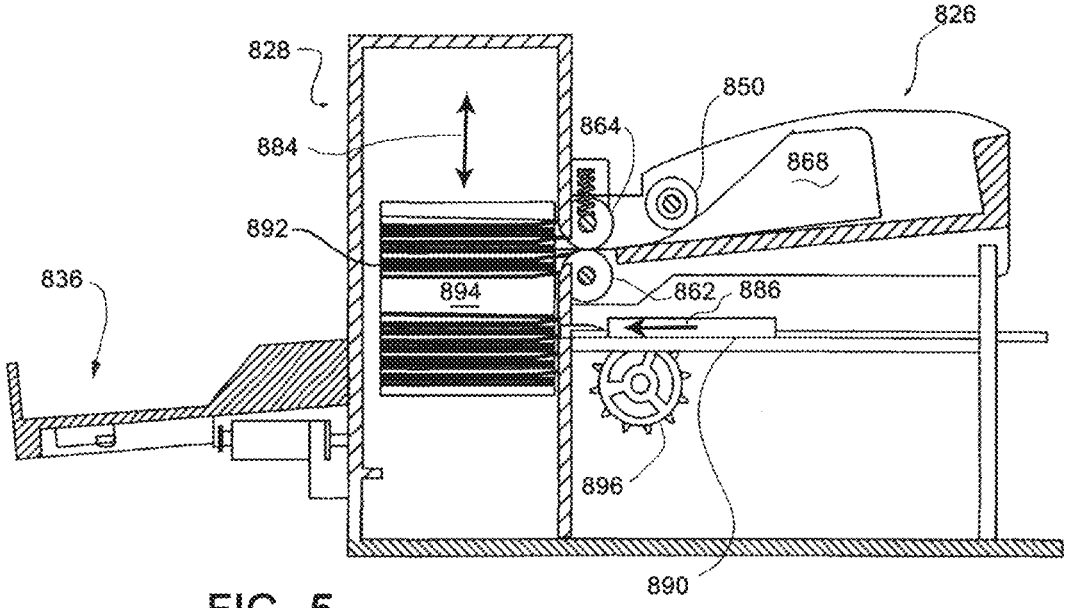
FIG. 5 PRIOR ART
FIG. 5 is another view from the prior art carousel shuffler patent disclosure in FIG. 4.
Figure 6:
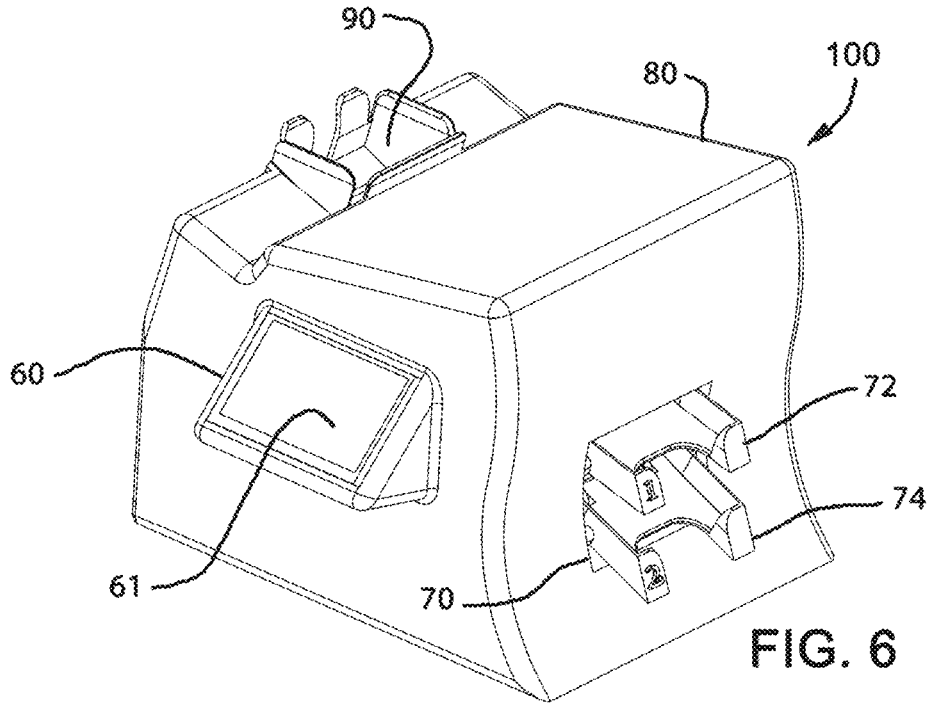
FIG. 6 is a perspective view of the preferred embodiment of the present invention as it might appear in a casino poker room.

FIG. 6 illustrates a preferred embodiment of the apparatus disclosed herein as it might appear in the poker room of a casino. The apparatus 100 possesses a housing 80 and a control panel 60 which is positioned conveniently for a casino dealer (apparatus operator) on the exterior of the housing. The housing is able to stand upon the surface of a casino table or an adjacent stand. At least one microcontroller (not shown) controls the operation of the apparatus, including operation of the control panel. Control panel 60 includes a 5-inch touchscreen 61 that is used to program the apparatus for various poker games. For size reference, a 5-inch touchscreen is slightly smaller than the smaller touchscreens used in today's mobile phones. Prior to each game, the dealer will utilize the touch screen 61 to program the apparatus for various game parameters, such as to produce the required number of cards in each hand as required by various forms of poker. Additionally, the dealer will program the apparatus to accommodate the number of players participating in the game. The touchscreen will also indicate status such as possible malfunctions and security issues to the dealer. For example, the microcontroller counts the number of cards sorted in each deck and will issue a warning on the touch panel if that number is unexpected due to player or dealer cheating.

Input portal 90 is designed to receive and hold a deck of unshuffled cards. Upon dealer command, those cards are transported individually into a randomizing mechanism which randomizes the cards and separates them into play-ready hands by sorting cards into a plurality of nests. An indicator on the touch panel notifies the dealer when the play-ready hands are ready for distribution to the players. Thereafter, the dealer commands the apparatus to deliver shuffled hands (play-ready substacks) in pairs to the two output trays 72 and 74 of the discharge portal 70. The two output trays are labeled as tray "1" and tray "2" and are injection molded from a transparent plastic material such as polycarbonate. At the initiation of the game, the microcontroller will discharge two play-ready substacks simultaneously to the two output trays. Thereafter, the apparatus will automatically discharge a new play-ready substack to each vacant output tray immediately after a previous hand is removed.

Figure 7:
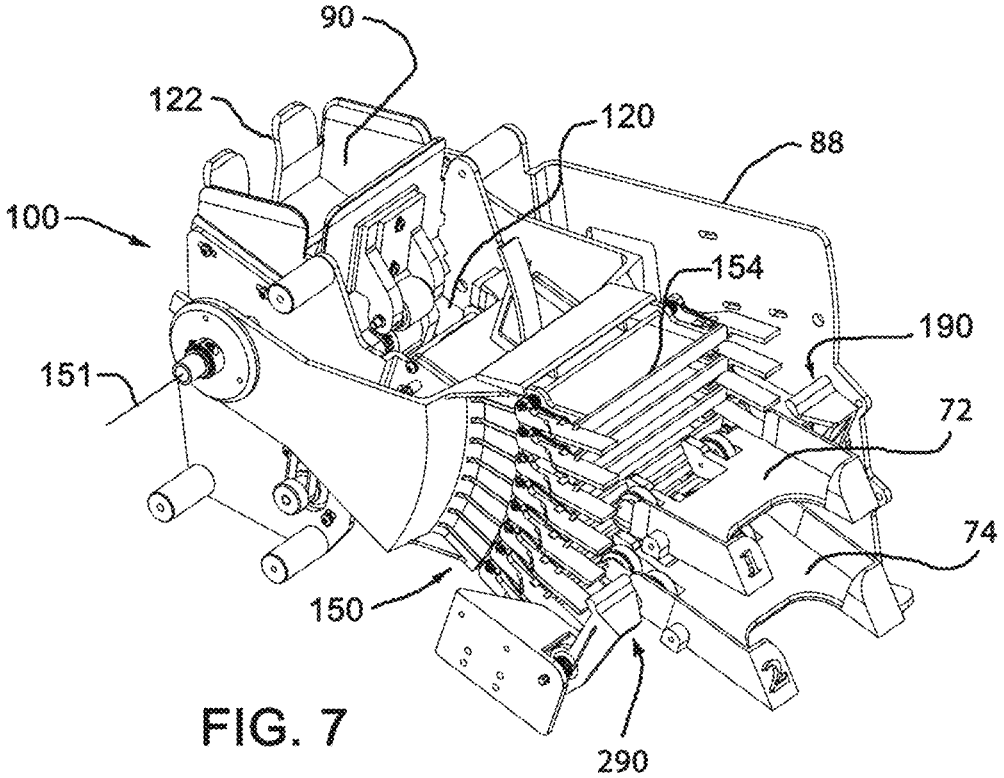
FIG. 7 is a perspective view of the preferred embodiment with its cover housing removed.

An overall view of the internal mechanisms of the apparatus is shown in FIG. 7 where the exterior housing and the nearest side frame are not shown for the purpose of illustration. There are several major subassemblies shown in this figure, including a card transport 120, a radial receiver 150, a first selector 190, a second selector 290 and the two output trays 72 and 74. The major assemblies are supported by far sideframe 88 (shown) and near sideframe 89 (not shown).

Briefly, the card transport 120 moves individual cards from the unshuffled card tray 122 and moves them individually into one of eight randomly selected nests within the radial receiver 150, which rotates about axis 151. The microcontroller utilizes a subroutine called a "random number generator" to generate a random address for selecting one of the eight nests for inserting each card as it is moved from the card tray 122. Each nest has a moveable retainer 154 which retains the substacks within the nests as the card receiver 150 rotates. When the nests have accumulated sufficient number of cards to form the hands (substacks), the radial receiver 150 is rotated to discharge the contents of each nest (play-ready substack) into one of the two output trays. The play-ready substacks are discharged to the output tray 72 by centrifugal force after the selector 190 intercepts one of the actuation arms 155R of a randomly chosen nest retainer 154. Substacks are discharged to the output tray 74 by centrifugal force after the selector 290 intercepts one of the actuation arms 155L of a randomly chosen nest retainer 154. In each case, the inertia of the substack carries it into the output tray as a result of centrifugal force.

Figure 8:
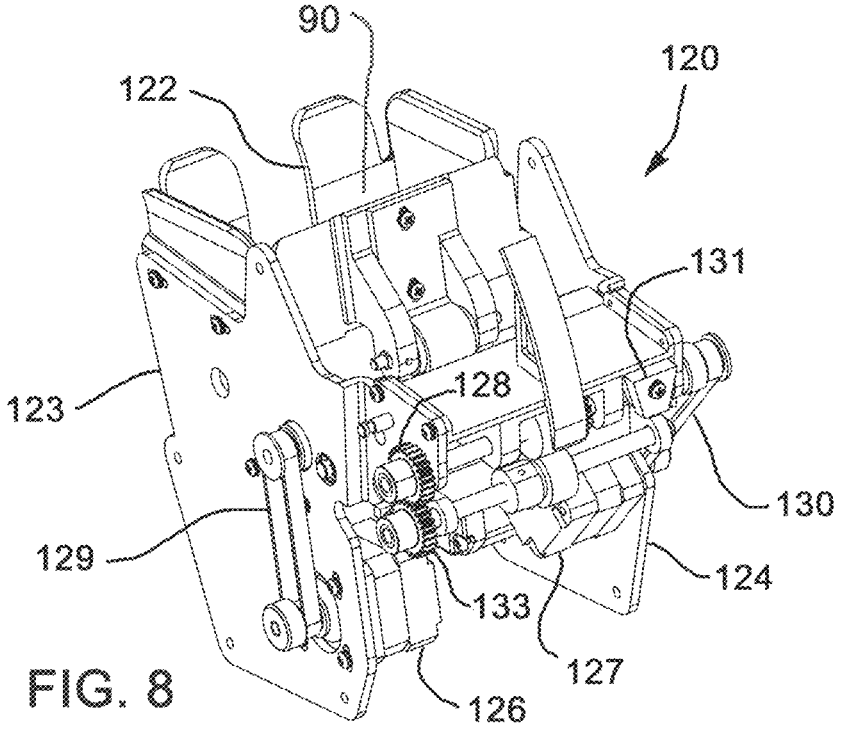
FIG. 8 is a perspective view of the card transport of the preferred embodiment when isolated from the apparatus.

An isometric view of the card transport assembly 120 is shown in FIG. 8. Individual cards are moved from the unshuffled card tray 122 and into the radial receiver 150 by two motors. Motor 126 rotates a set of stripper rolls 135, 136 via timing belt 129 which removes one card at a time from the unshuffled stack. Motor 127 rotates a set of flick rolls via timing belt 130 which accelerates each card into the nests within the radial receiver 150.

Figure 9:
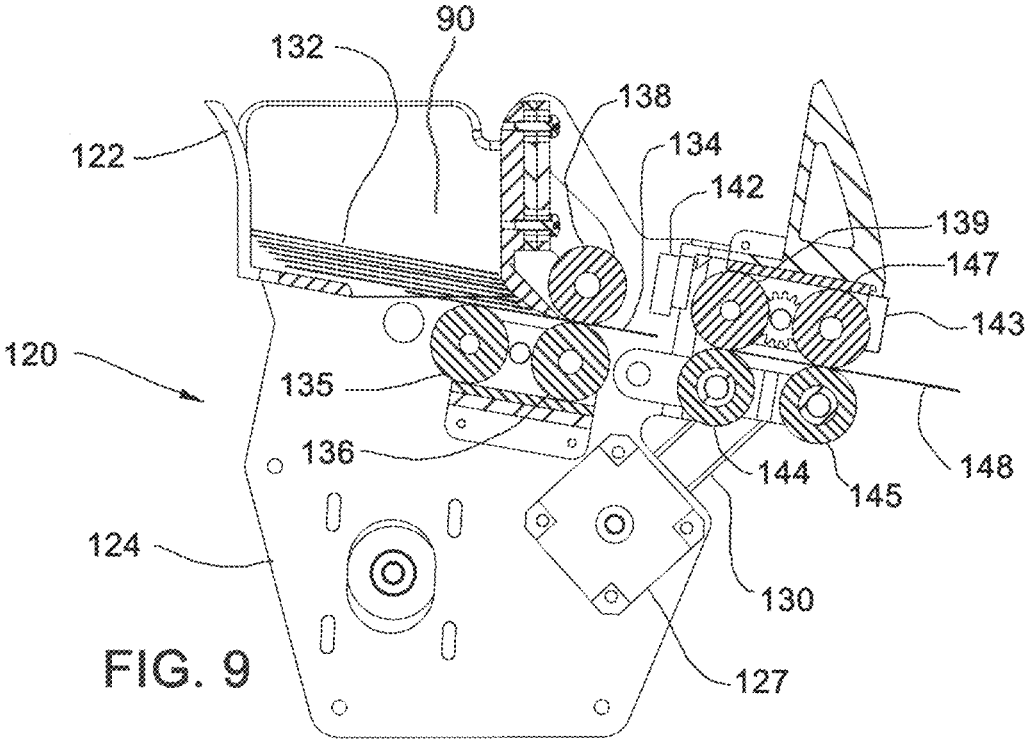
FIG. 9 is a side elevation section view of the card transport of FIG. 8.

FIG. 9 is a section view of the card transport 120 which shows a series of rubber covered transport rolls which illustrate the functionality of the two motors 126 and 127. A stack of cards 132 is shown in the unshuffled card tray 122 where the stack is partially supported by strip roll 135. Motor 126 rotates strip rolls 135, 136 and 138 to "strip" individual cards from the bottom of stack 132 and transports each card until its edge is detected by optical sensor 142. If there exists a second card 148 ahead of card 134, then the strip motor temporarily ceases motion of card 134. The "card transport path" is defined as the axis defined by an imaginary line along the surfaces of cards 134 and 148.

The optical sensor 143 is utilized to detect the leading and trailing edge of card 148 which is engaged in the forward set of four rolls which are referred to as the "release rolls" 144, 145, 139 and 147. If the trailing card 134 is stopped, then motor 127 will move the leading card 148 with rapid acceleration into the nests of the radial receiver 150. When the trailing edge of card 148 is detected by optical sensor 143, both motors will activate to feed card 134 forward to the release rolls 139, 147, 144 and 145. Additionally, optical sensor 143 is used by the microcontroller to count the cards being inserted into each nest.

Card 134 in FIG. 9 has been advanced until its leading edge is detected by optical sensor 142. It is said to be queued and ready to advance into the release rolls when card 148 enters its target nest. After the trailing edge of card 148 passes the forward sensor 143, the radial receiver 150 will rotate to its next random nest position as directed by the random number generator in the microcontroller. Simultaneously, the card 134 will advance into the release rolls until detected by forward sensor 143.

The microcontroller keeps track of the cumulative card count in each nest, and therefore "knows" when that nest is "play-ready" for discharge. The definition of a "play-ready" nest is a nest that has accumulated the correct number of cards that correspond to the size of the hand that is programmed for the game underway. When a nest achieves the "play-ready" state, the microcontroller no longer directs cards to that nest.

Once the newly moved card enters into the forward release rollers (FIG. 9), it will be stopped when its leading edge is detected by optical sensor 143. That card will remain in that state until a randomly selected nest within radial receiver 150 becomes positioned to receive it. After accelerating the forward card from the release rolls into the radial receiver 150, the transport cycle of motors 126 and 127 will be repeated simultaneously with the rotation of the radial receiver 150 to its next insertion position.

Figure 10:
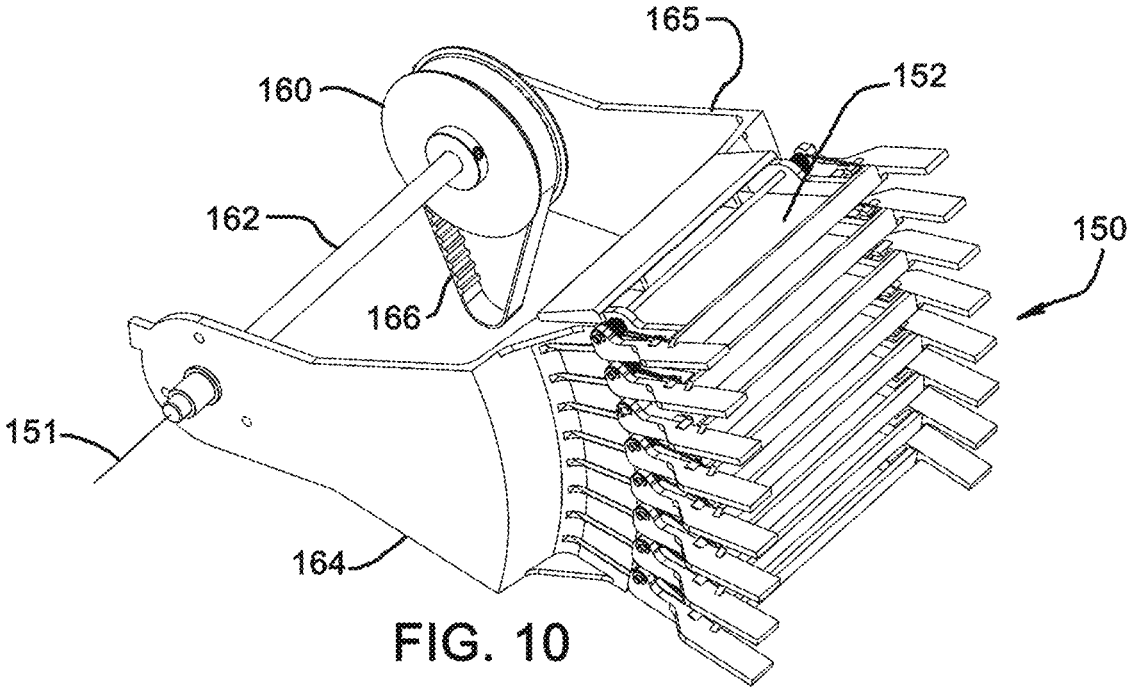
FIG. 10 is a perspective view of the radial receiver of the preferred embodiment.

An isometric view of radial receiver 150 is shown in FIG. 10 where this assembly is isolated from the overall mechanism shown in FIG. 7. The radial receiver 150 comprises a plurality of nests 152 which are radially-arranged and mounted to carrier arms 164 and 165. There are eight (8) nests in the preferred embodiment. The entire assembly rotates about axis 151 and is rotationally driven by a carrier drive motor (not shown). The drive motor is connected to the carrier arm 165 by timing belt 166 and pulley 160 which is rigidly attached to carrier arm 165. Angular motion of the entire assembly 150 about axis 151 is controlled by a microcontroller. The microcontroller and drive motor together are capable of rotating the radial receiver 150 with angular precision and with significant angular acceleration while positioning any one of the eight nests into radial alignment with the card transport path of the card transport 120.

The apparatus is designed for hosting games at a poker table having a maximum of seven player positions. In those games where participants play against the dealer (apparatus operator), the apparatus can form seven player hands and one dealer hand. In some embodiments and depending upon the game parameters, the dealer will also have a choice of picking his/her hand from either of the two output trays. The microcontroller will utilize the touch screen to alert the dealer that the required hands are fully formed within the device and available for discharge upon dealer demand. Alternately, the apparatus 100 may be programmed to automatically deliver the initial two substacks to the output trays 72 and 74 immediately after the apparatus achieves a sufficient number of nests having "play-ready substacks.

Figure 11:
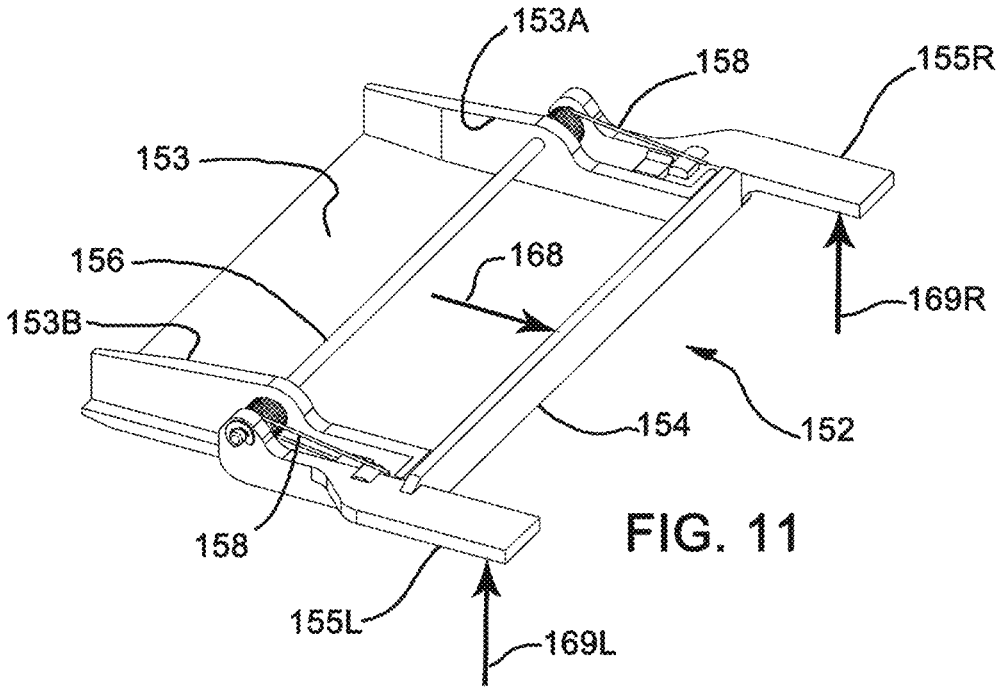
FIG. 11 is a perspective view of a single card substack nest of the preferred embodiment.

A single nest assembly 152 is shown isolated in the perspective view of FIG. 11 and comprises a nest base 153 and a movable retainer 154, which are both made of injection molded plastics. Card substacks are retained within the nests laterally by the walls 153A and 153B. The card substacks are retained along the direction of arrow 168 by the retainer 154, where arrow 168 represents the direction of the centrifugal force which is created by the rotation of the radial receiver 150. The substacks are aligned against the surface of retainer 154 by the centrifugal force as cards accumulate within the nests.

Referring to FIG. 11, each retainer possess two actuation arms 155R and 155L which are rigidly attached to the retainer. Movement against actuation arm 155R in the direction of arrow 169R induces retainer 154 to pivot about a stainless steel pin 156 which functions as the retainer's axle. Likewise, movement against actuation arm 155L in the direction of arrow 169L induces retainer 154 to pivot about its stainless steel pin 156. In this way, retainer 154 can be induced to pivot about axle 156 by either a force against arm 155R or a force against arm 155L.

Two torsion springs 158 hold retainer 154 in the position shown during the operational procedures utilized for distributing random cards to the nests. The edges of the accumulated card substacks are forced against the internal edge of the retainer 154 in the direction of arrow 168 by centrifugal force during rotational motion of the radial receiver 150. The centrifugal force acts in a beneficial manner to retain and align the edges of the substacks during the rotational excursions of radial receiver 150.

FIG. 12 illustrates the state where the retainer 154 is pivoted to a displaced position, creating an exit orifice 157 which allows play-ready substacks to escape from the nest assembly 152. The exit orifice 157 is temporarily created by an actuating force that contacts either of actuation arm 155R or 155L in the direction of arrow 169R or 169L. In this figure, the actuation arm 155R is being induced to move by a force directed in the direction of arow 169R. Movement of arm 155R or 155L pivots the retainer 154 about pin 156 against the restoring action of torsion springs 158, thus creating the exit orifice 157.

The entrance orifices 159 to the nest assemblies 152 are shown in an isometric view of the radial receiver 150 in FIG. 13. This view illustrates the internal nest orifices which are each randomly aligned with the card path of card transport 120 for moving cards individually into the nests 152. Each nest has a capacity of 27 cards which is slightly more than one-half of a card deck. However, the maximum expected hand size is 7 cards in the case of seven card stud poker. The oversize nests guarantee that the card substacks will always be retained loosely within the nests. While the exit orifice 157 (FIG. 12) is sized to allow 27 cards to escape, the entrance orifice of each nest is larger, with an equivalent size of 36 cards. Thus, one characteristic of the preferred embodiment is the distinction that the entrance orifice of each nest is significantly larger than the exit orifice. Cards move into the nests and out of the nests in the same centrifugal force direction as indicated by arrow 168 in FIG. 11.

Figure 14A:
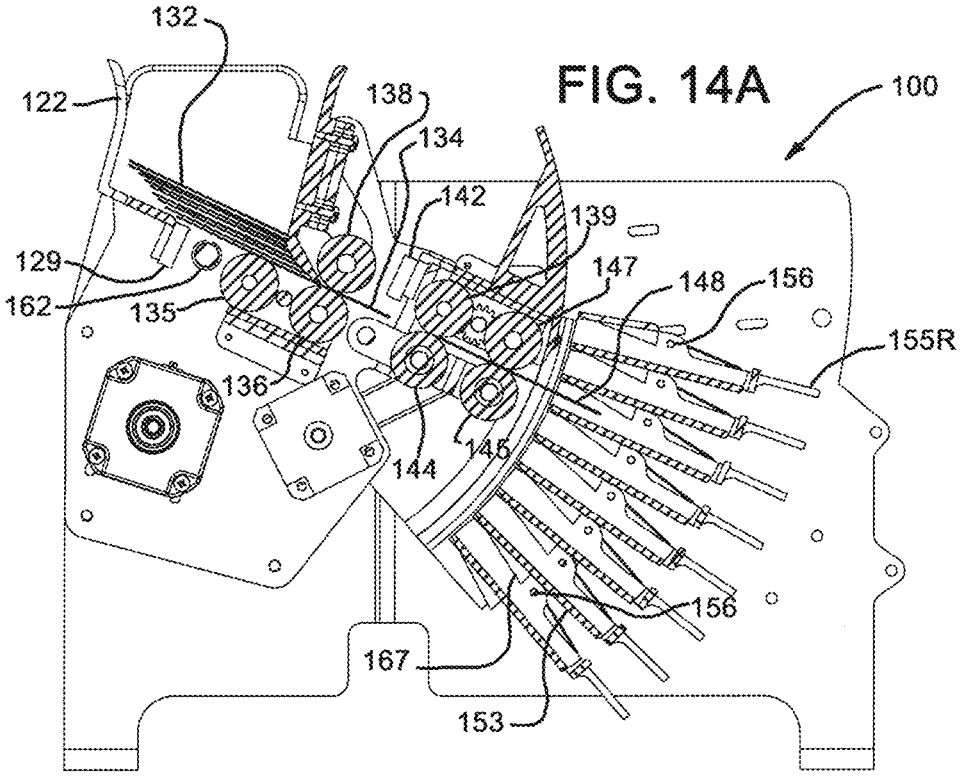
FIG. 14A is a partial side elevation section view of the preferred embodiment shuffler.

FIG. 14A is a partial section view that illustrates the card path from the card transport 120 to the radial receiver 150. The two output trays 72, 74 and the two selectors 190 and 290 are omitted from this section view for clarity. Two cards 134 and 148 are shown along the card transport path. Radial receiver 150 has been rotated about its axle 162 to align a nest (third from top) with the card transport path of the card transport 120. The leading edge of a card 148 is shown entering into the third nest from the top of the radial receiver 150. That card is being propelled with acceleration by the release rolls 139, 147, 144 and 145. Each nest base 153 possesses a deflection fin 167 on its lower side, which functions to deflect cards underneath the pivot pin 156. The distance from the floor of nest 153 to the tip of the fin 167 establishes the nest capacity of 27 cards.

Card 134 in FIG. 14A has been advanced until its leading edge is detected by optical sensor 142. It is said to be queued and ready to advance into the release rolls when card 148 enters its target nest. After the trailing edge of card 148 passes the forward sensor 143 (see FIG. 9), the radial receiver 150 will rotate to its next random nest position as directed by the random number generator in the microcontroller. Simultaneously, the card 134 will advance into the release rolls until detected by forward sensor 143 (see FIG. 9).

Figure 14B:
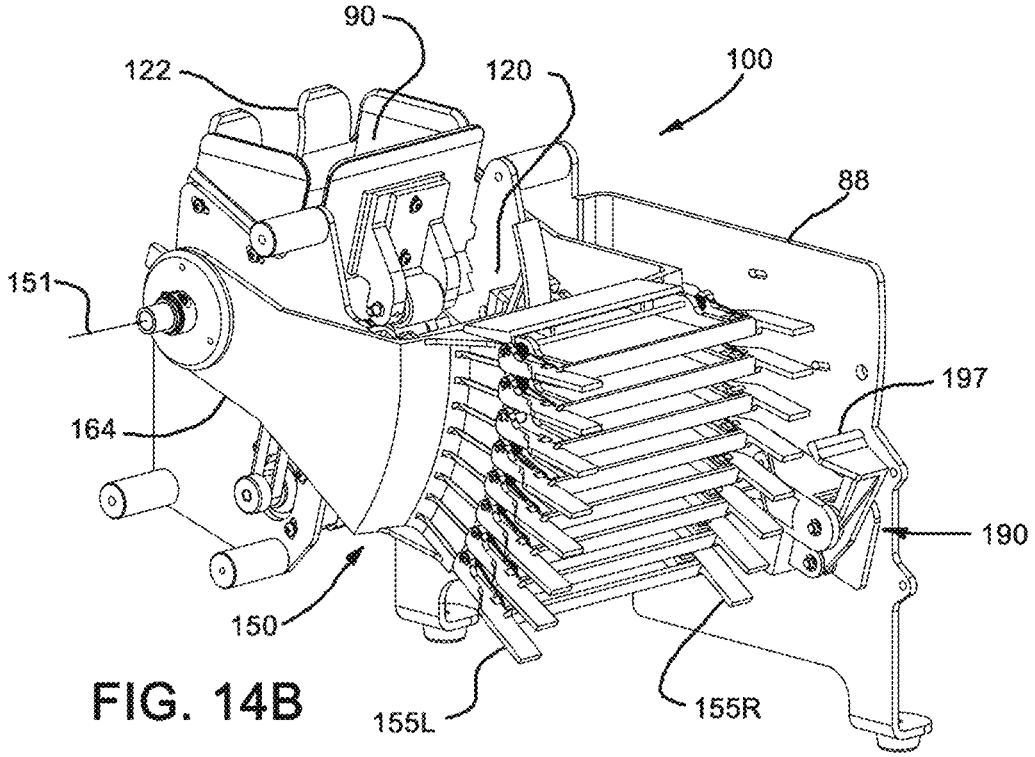
FIG. 14B is a partial perspective view of the preferred embodiment shuffler showing the first selector.

Centrifugal force and resulting inertia move the substacks from the individual nests of the radial receiver 150 to either of the output tray 72 or 74 after enabling one of the selectors 190 or 290. Actuation of the first selector 190 is used to discharge play-ready substacks into the first output tray 72, while actuation of the second selector 290 is utilized to discharge play-ready substacks into the second output tray 74. Referring to FIG. 14B, the first selector 190 is mounted laterally from the nests and is shown rigidly mounted to the far sideframe 88.

FIG. 14B is a partial isometric view of the preferred embodiment. The near sideframe 89, the second output tray 74 and the second selector assembly 290 have been omitted from this view for the purposes of explaining operation of the first selector 190. The first selector 190 is a solenoid-driven actuator that possesses a bulbous tip 197 whose purpose is to intercept the path of the actuator arms 155R.

FIGS. 15A, 15B and 15C illustrate the configuration and actuation motion of the first selector 190 in isolation. FIG. 15A shows the first selector 190 in the deactivated condition while FIG. 15B shows the first selector in its activated state. Actuation of the first selector 190 is utilized to discharge play-ready substacks to the first output tray 72 which is labeled numeral "1".

Referring to FIG. 15A, the first selector 190 consists of selector arm 192, a pivot pin 195, an open frame solenoid 193, and a return (torsion) spring 196 as also shown in the alternate view FIG. 15C. The mechanism is mounted to an injection molded housing 194 which is utilized to mount the mechanism rigidly upon the sideframe 88. The selector arm 192 is an injection molded component which possesses a bulbous actuation finger 197 at its extremity. The solenoid is not activated in FIG. 15A and the torsion spring 196 is holding the selector arm 192 in the position shown, which is called the deactivated position. In FIG. 15B, the solenoid 193 has been actuated by a voltage pulse which causes the selector arm 192 to rotate counter-clockwise about pin 195, moving the actuation finger 197 in the direction of arrow 198. This state is called the activated position of the first selector.

Figure 16:
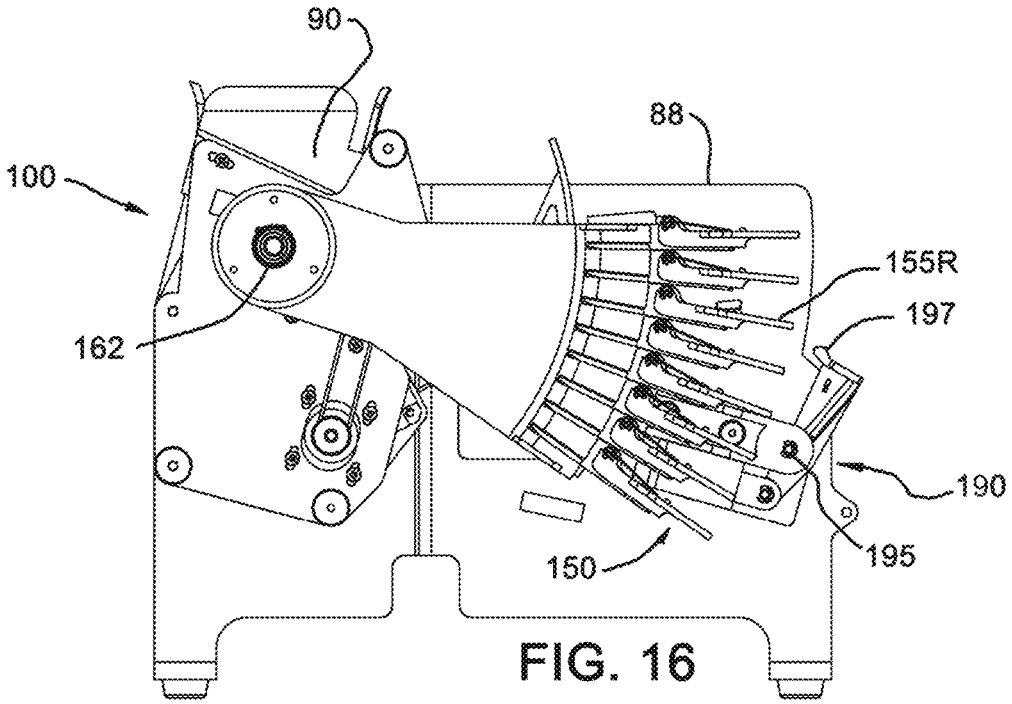
FIG. 16 is a side elevation view showing the first selector in its inactive state.
Figure 17:
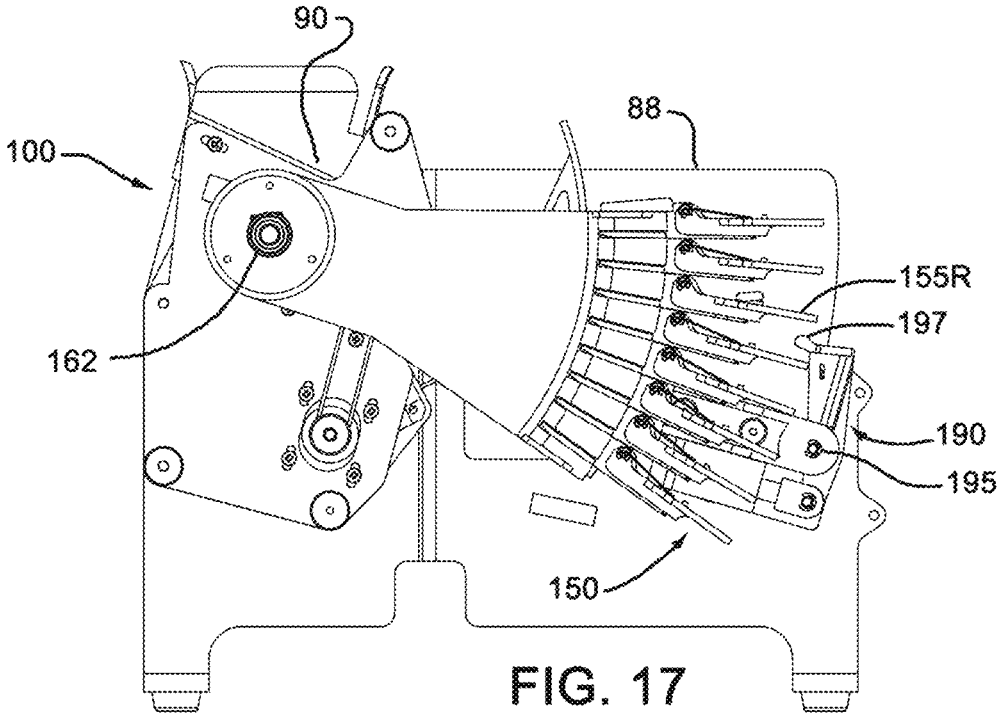
FIG. 17 is a side elevation view showing the preferred embodiment in one of its "pre-launch" states.

The side elevation views in FIG. 16 and FIG. 17 are intended to explain the operation of the first selector 190. For simplicity, these views omit the output trays 72, 74, the second selector 290 and the near sideframe 89. The first selector 190 is used to enable the movement of any of the movable retainers 154 by intercepting the path of any of the eight actuation arms 155R. Referring to FIG. 16, the selector 190 is shown in its deactivated position where it's tip 197 is unable engage the circular path formed by the of the arms 155R.

Referring to FIG. 17, the first selector 190 is shown in the actuated position and the radial receiver 150 has been rotated about axle 162 to a "pre-launch" position prior to launching a play-ready substack into the first output tray 72. The radial receiver is angularly positioned and temporally paused to allow the selector tip 197 of the first selector to enter into an opening between the actuation arms 155R in this "pre-launch" state.

If no cards are present in the output tray 72, the apparatus 100 is ready to launch a play-ready substack into the output tray. In FIG. 17, the radial receiver 150 has been momentarily stopped while the selector tip 197 is injected into the path of the 3rd nest from the top and is in a position to intercept arm 155R of that nest when the radial receiver 150 rotates clockwise. FIG. 17 thus illustrates the "pre-launch" state of the apparatus 100 when it is about to move a play-ready substack into an output tray.

Figure 18:
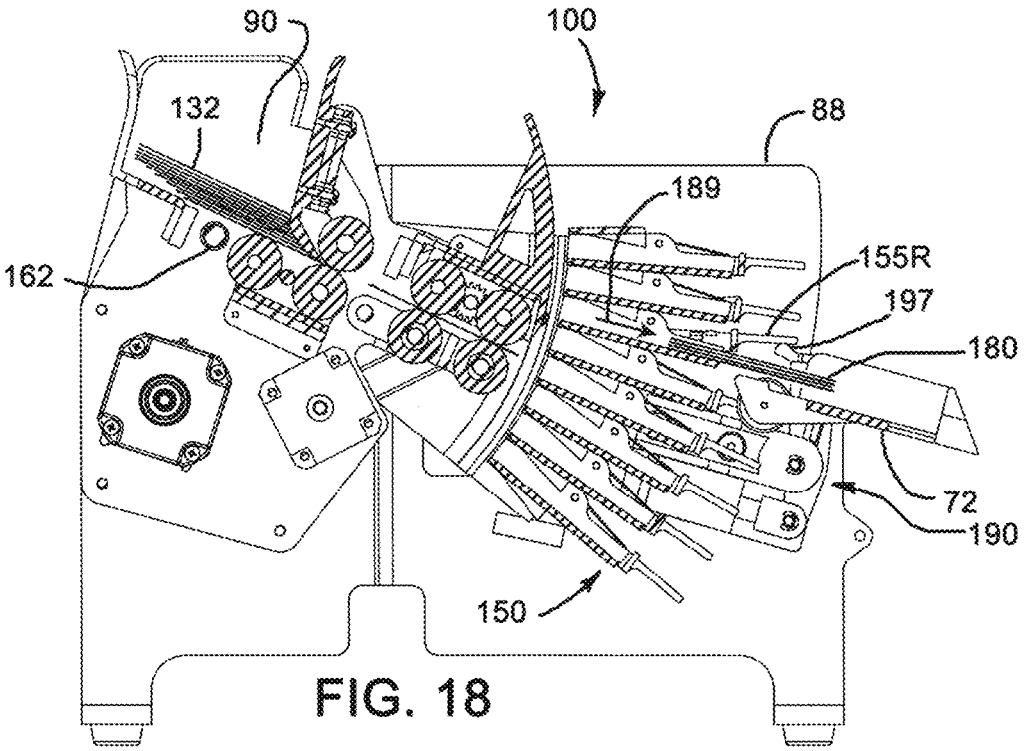
FIG. 18 is a side elevation view showing a card substack being launched into the first output tray.

FIG. 18 is a section view of the apparatus 100 while discharging a substack. While the first selector 190 is held in this actuated position (FIG. 17), the radial receiver 150 is thereafter rapidly rotated clockwise and rapidly stopped at the card delivery position as shown in FIG. 18 where the actuation arm 155R has been displaced by the selector tip 197. Movement of the arm 155R creates the exit orifice 157 as shown in FIG. 12. The deceleration causes centrifugal force and inertia to rapidly discharge the substack 180 into the output tray 72 while the moveable retainer 154 is restrained. Arrow 189 indicates the direction of the centrifugal force as the radial receiver 150 reaches its terminal clockwise destination. After a momentary pause, the radial receiver 150 is returned counterclockwise to the "pre-launch" position and the solenoid 193 is deenergized, allowing the torsion spring 196 to extract the first selector tip 197 from the path of actuator arms 155R. The apparatus 100 is then ready to move another play-ready substack from another nest 152 to either of the output tray 72 or output tray 74.

Figure 19:
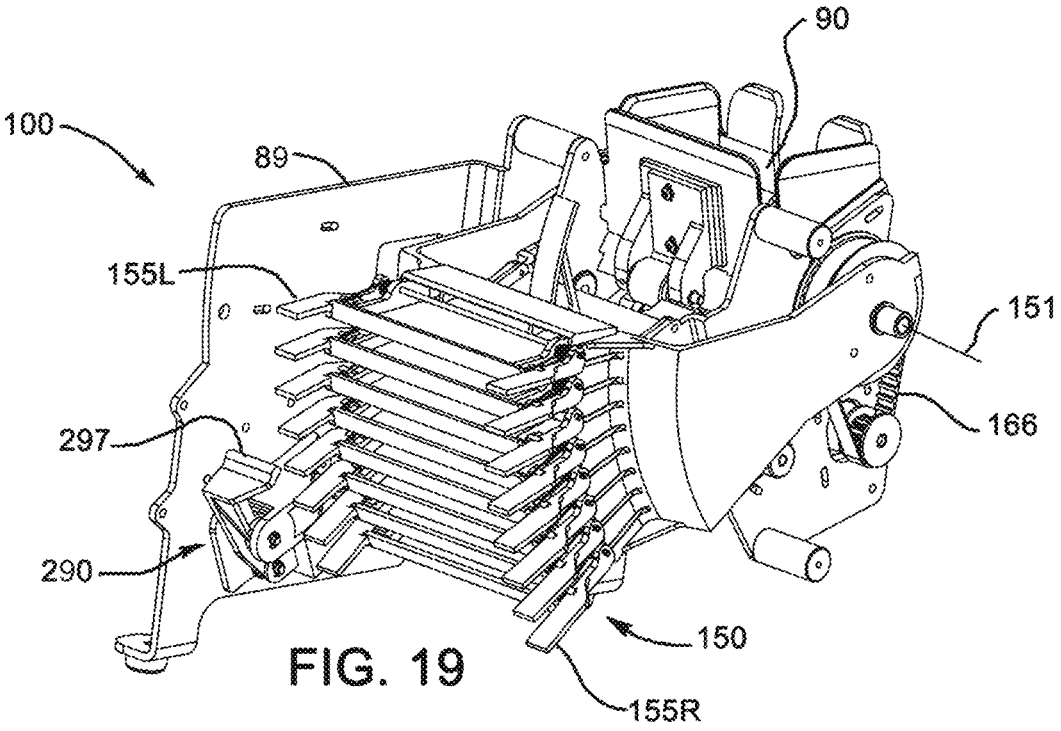
FIG. 19 is a partial perspective view showing the second selector at its inactive state.

The second selector 290 is mounted on the opposite sideframe as the first selector 190 and is utilized to intercept actuator arms 155L of the radial carrier assembly 150. FIG. 19 shows the second selector rigidly mounted to the near sideframe 89. This isometric view omits the output trays and first selector for clarity. The second selector configuration is a mirror image of the first selector configuration.

Referring to FIG. 20A, the first selector 290 consists of selector arm 292, a pivot pin 295, an open frame solenoid 293, and a return (torsion) spring 296 (not visible). The mechanism is mounted to an injection molded housing 294 which is utilized to mount the mechanism rigidly upon the sideframe 89. The selector arm 292 is an injection molded component which possesses a bulbous actuation tip 297 at its extremity. The solenoid 293 is not activated in FIG. 20A and the torsion spring 296 is holding the selector arm 292 in the position shown, which is called the deactivated position. In FIG. 20B, the solenoid 293 has been actuated by a voltage pulse which causes the selector arm 292 to rotate clockwise about pin 295, moving the actuation tip 297 in the direction of arrow 298. This state is called the activated position of the second selector.

Discharge of a play-ready substack into the second output tray 74 is accomplished in the same way as the discharge cycle for the first output tray 72. The radial receiver 150 is moved to a "pre launch" position and the solenoid 293 is thereafter activated to inject the selector tip 297 into the path of the actuation arms 155L. The radial receiver is thereafter rotated CCW to intercept the actuation arm 155L as shown in FIG. 21. Referring to the section view of FIG. 21, substack 280 is being discharged into the second output tray 74 in the direction of arrow 289, where arrow 289 represents the direction of the centrifugal force.

Figure 22:
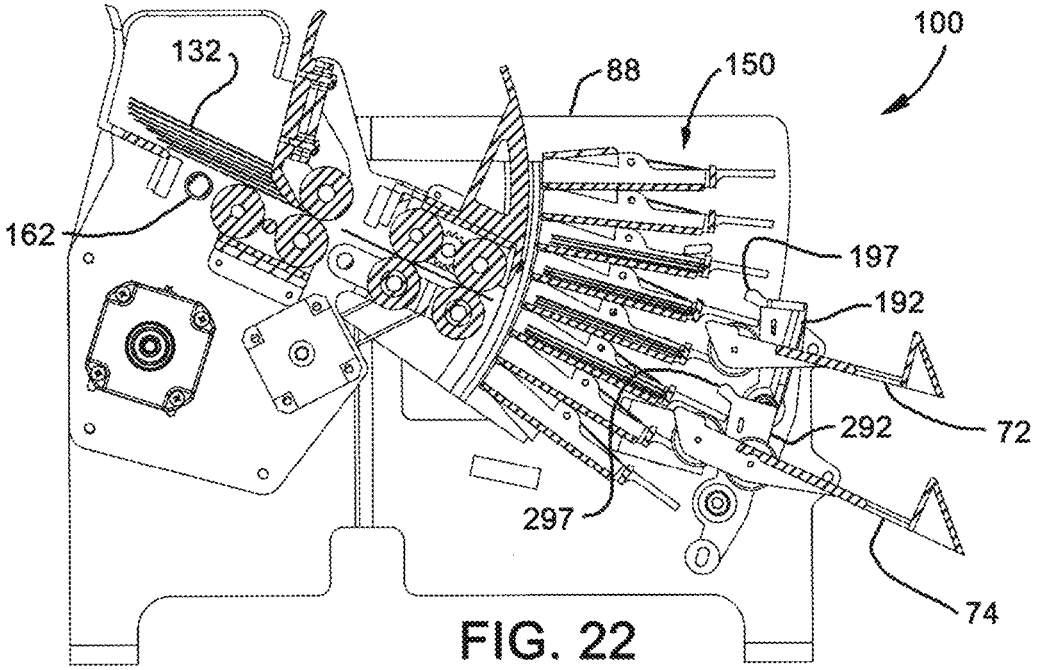
FIG. 22 is a side elevation section view showing the preferred embodiment in its "pre-launch" state prior to simultaneously launching substacks into both output trays.
Figure 23:
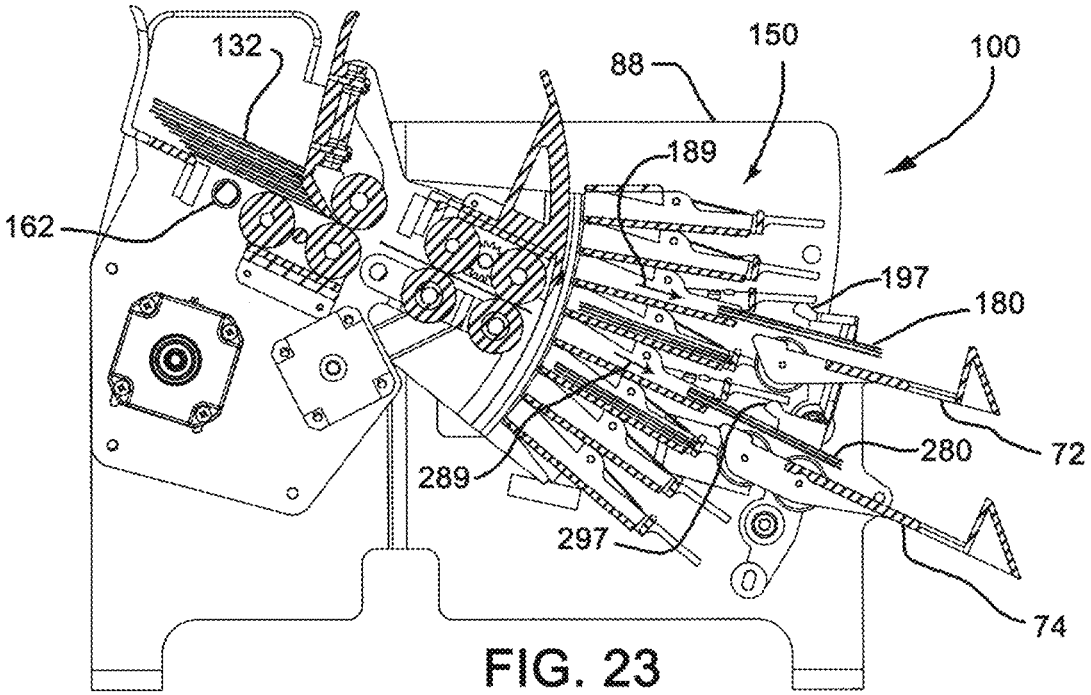
FIG. 23 is a side elevation section view showing the preferred embodiment simultaneously launching substacks into both output trays.

A novel attribute of the apparatus described herein is its ability to discharge two play-ready substacks to the two output trays simultaneously. This feature is achieved by moving the radial receiver 150 to a "pre-launch" position, actuating the first selector solenoid 193 and the second selector solenoid 293 simultaneously, and thereafter rotating the radial receiver 150 to discharge two substacks simultaneously. FIG. 22 and FIG. 23 illustrate the geometric configuration that achieves this feature. Referring to FIG. 22, the first selector arm tip 197 and the second selector arm tip 297 are shown in relation to the radial receiver 150 at the "pre-launch" position. This illustration is constructed in the direction of viewing the far sideframe 88 with the selector arm orientations superimposed upon the view. The two selector arms 192 and 292 are offset along the circular path of the actuation arms 155R and 155L by a distance equal to twice the angular offset of the nests. Selector tip 197 is in its "pre-launch" position and is positioned within the gap between the third and fourth actuator arm 155R. Upon a CW movement of the radial receiver 150, the selector tip 197 will intercept the retainer arm 155R of the nest that is located in the third position from the upper nest.

Selector tip 297 is also in its "pre-launch" position and positioned with in the gap between the fifth and sixth actuator arm 155L. Upon a CW movement of the radial receiver 150, the selector tip 297 will intercept the retainer arm 155L of the nest that is located in the fifth position from the upper nest.

Movement of the radial receiver in the CW direction then induces substacks 180 and 280 to be discharged into both output trays simultaneously as shown in FIG. 23. Referring to FIG. 23, substack 280 is being discharged in the direction of arrow 289 simultaneously with the discharge of substack 180 in the direction of arrow 189. This simultaneous discharge feature is executed at the initiation of each game, allowing the first player to randomly choose his/her play-ready hand from either of the two output trays. The dealer (apparatus operator) then removes the chosen substack and delivers it to the player having made the choice.

Each output tray 72 and 74 possesses a "card present" sensor (not shown) which detects the presence of cards. When the dealer removes a play-ready substack from one of the output trays, the sensor in that tray alerts the microcontroller that the tray is vacant. The apparatus then rotates the radial receiver 150 to discharge a play-ready substack to the vacant output tray and the apparatus automatically discharges the next play-ready substack when the tray sensor indicates that the dealer has removed a substack. The discharge cycle repeats until all of the required hands are delivered to the players. In one embodiment where the participants play against the dealer in games such as in Caribbean Stud® or Three-Card Poker®, the dealer will additionally be given the opportunity to choose his/her hand from one of the output trays. Some games such as Mississippi Stud or Texas Hold-em require community cards. In those games, the apparatus will discharge a sufficient number of cards to both output trays and the dealer will collect the cards from both output trays to be used as community cards.

After the hands have been distributed to all players, there are various amounts of cards left in the nests and in the unshuffled card portal. For example, for certain 7-card stud games such as "Rollover" or "Baseball", each hand consists of seven cards which are delivered to each player, and no additional cards are needed for that game. If there are five players, then thirty-five (35) cards will have been dealt, leaving seventeen (17) cards within the apparatus. Some of these residual cards will have been delivered to unfilled nests and some will remain within the unshuffled card tray 122. Comparatively, a game of Three-Card Poker® with five players will only utilize eighteen (18) cards (five player hands and one dealer hand). In this latter case, the majority of cards will remain unplayed and the dealer will purge the apparatus of these residual cards before starting a new game. This process is called the purging cycle.

While forming hands, the microcontroller tracks the number of cards moving into and out of each nest, and "knows" how many residual cards remain in each nest, if any, at the end of each poker game. Within the purging cycle, the microcontroller rotates the card receiver 150 four times to align each pair of nests with the two output trays, and thereafter simultaneously discharges residual cards to both output trays 72 and 74. This part of the purging cycle is thus accomplished at least twice as fast as the prior art hand-forming devices. However, additional residual cards remain in the unshuffled card tray 122 and the microcontroller does not "know" the number of cards remaining in that unshuffled card portal.

The dealer has options in regard to purging those cards remaining in the unshuffled card portal. In one embodiment, the dealer may program the apparatus 100 to sort the cards remaining in the unshuffled card portal into the nests, and thereafter deliver them in pairs to the output trays. In another embodiment, the dealer may program the apparatus to purge the residual cards by rapidly delivering the unshuffled cards directly from the unshuffled card portal to the second output tray 74.

This latter "rapid purge" option includes rapidly purging the residual cards from within the individual nests and rapidly purging unshuffled cards that remain from within the input portal.

Figure 24:
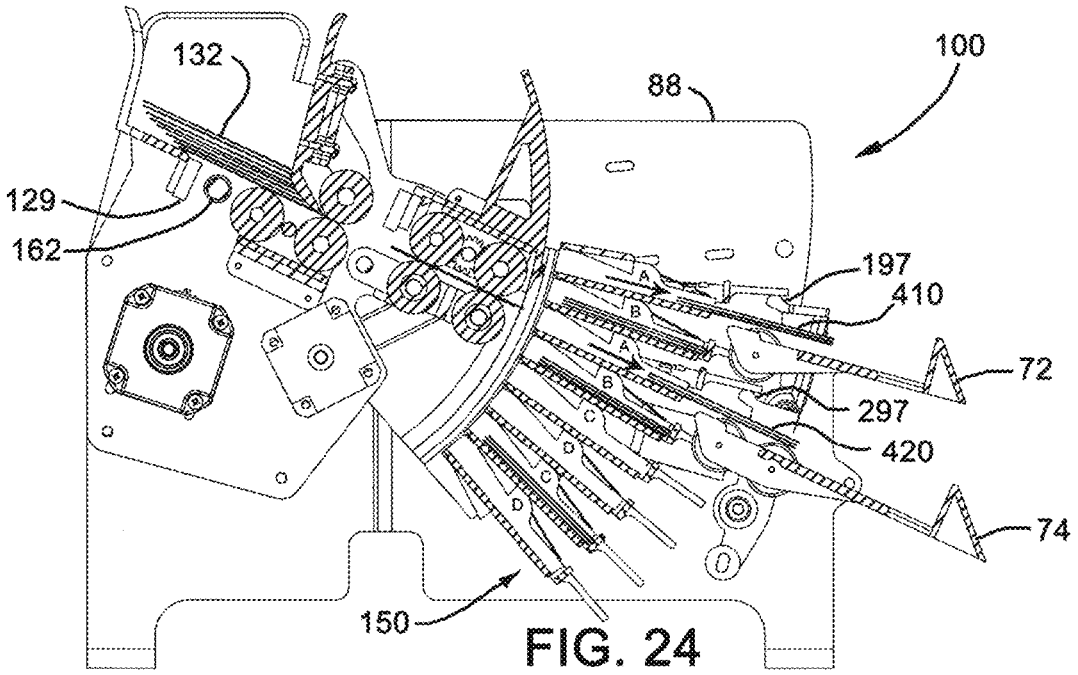
FIG. 24 is a side elevation view illustrating the sequence of discharge movements for rapidly purging the apparatus of residual cards.

The process of purging cards from within the nests exploits the ability of the apparatus to discharge two substacks simultaneously. All of the nests can be purged by making four discharge movements of the radial carrier 150. FIG. 24 illustrates the sequence of purging the nests where the two nests designated "A" are first discharged, followed by the two nests labeled "B", followed by the "C" nests and finally the "D" nest pair. The "A" nest pair is being purged in this illustration where substack 410 is being discharged to the first output tray 72 and the substack 420 is being discharged to the second output tray 74. Note that residual cards exist in the first, second, third, fourth and seventh nest in this illustration, where the uppermost nest is considered the first nest.

Figure 25:
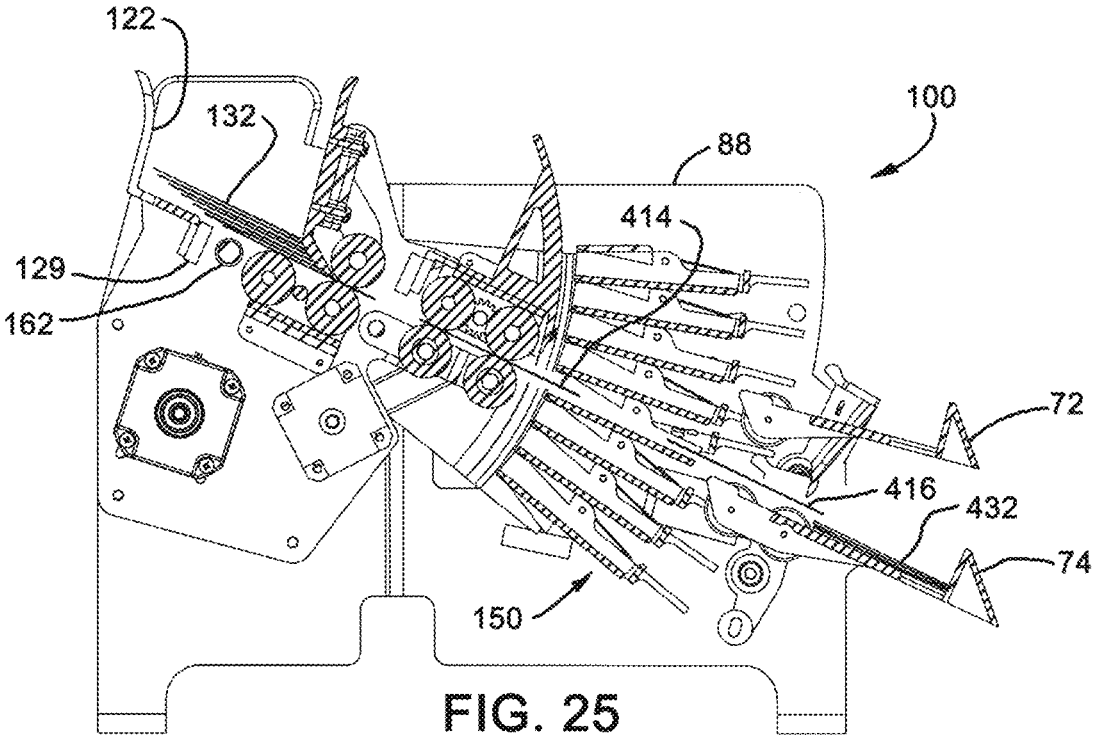
FIG. 25 is a section view of the preferred embodiment showing individual cards being purged from the input portal directly to the discharge portal.

The second portion of the "rapid purge" cycle is accomplished by aligning any nest within the radial receiver 150 with the path of the card transport as shown in FIG. 25, such that individual cards may be rapidly moved to the output tray 74 without requiring temporary storage within the radial receiver 150. The apparatus is geometrically configured to have a direct path from the input portal to the output portal in the position illustrated in FIG. 25. Referring to FIG. 25, card 414 and card 416 are being directly discharged along the card transport path to the output tray 74. An optical sensor 129 located in the floor of the unshuffled card input tray 122 alerts the microcontroller when no cards remain, and the optical sensor 143 (FIG. 9) will have finished its card count when the unshuffled card input tray 122 is empty.

At the termination of the purging cycle, the microcontroller will display the card count on the touch panel 61. If the count is unexpected, as for example from cheating by a player or dealer, then an error message and warning will be signaled to the dealer such as by a flashing visual indicator or audible warning. In this way, the deck size may be properly validated before commencing the next game.

The apparatus additionally possesses a security feature. In a security check mode, the individual cards of an unshuffled deck may be moved rapidly from the input tray 122 directly to the output tray 72 to perform a fast card count as shown by the illustration in FIG. 25. The microcontroller acquires the count as the cards pass the sensor 143 as shown in FIG. 9. Such a security count requires about 20 seconds and would be performed before bringing any new deck into play and with an existing deck periodically throughout a dealer's shift.

In a further embodiment, each player will not have the ability to choose an output tray as the source for their hand. Rather, the microcontroller will utilize its random number generator to randomly choose one of the output trays as the source for each player's substack. In yet another embodiment, the microcontroller will display a countdown timer on its touch panel to indicate the time allotted for each player to make his/her choice of output tray. For example, the apparatus may be programmed to allow each player 10 seconds to make his/her choice. If a player fails to make a choice within a certain time interval, the microcontroller will thereafter randomly choose the output tray source for that player.

Figure 26:
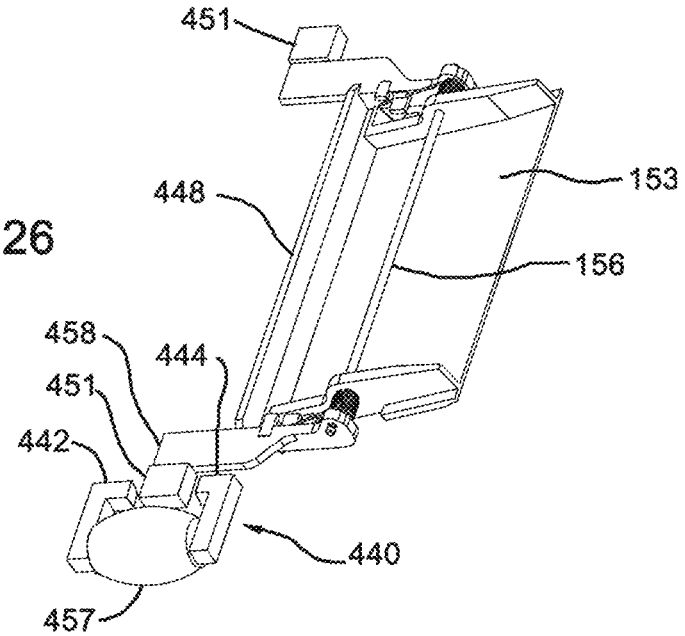
FIG. 26 shows an alternate embodiment of a substack nest retainer being actuated by magnetic coupling with an electromagnet.

The first selector and the second selector are implemented using electromagnets as actuators in an alternate embodiment as illustrated in FIG. 26. In this embodiment, the movable retainer 448 of each nest 153 possesses a small magnet 451 bonded to the terminal end of its actuator arm 458. The view in FIG. 26 illustrates an isolated nest 153 and the first selector 440 which is an electromagnet with an actuation coil 457. The electromagnet is fixedly attached to the sideframe 88 (see FIG. 14B). Application of a voltage to the actuation coil 457 creates a magnetic field across the terminal ends 442 and 444 of the electromagnet.

Referring to FIG. 26, the radial carrier 150 has positioned the nest 153 with magnet 451 near the field of the energized electromagnet 440 where the retainer's magnet 451 becomes magnetically coupled to the electromagnet 440. The radial carrier 150 is thereafter moved through a small angle to pivot the retainer 448 about its axle 156 to the position where its substack may escape by the influence of centrifugal force. When the electromagnet is not energized, magnet 451 on each retainer moves unimpeded through the gap of the electromagnet 440.

Figure 27:
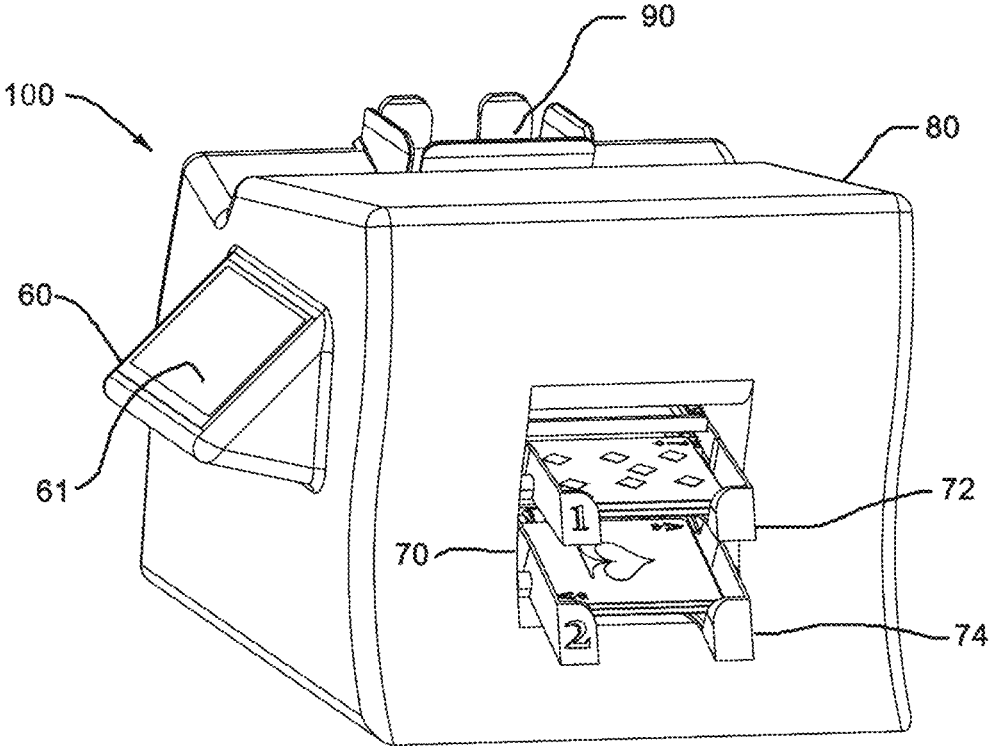
FIG. 27 shows an isometric view of the preferred embodiment when operating in a face-up card orientation.

The play-ready substacks are discharged to the output trays in a face-up orientation in yet another embodiment as illustrated in FIG. 27. Each player will then be given the ability to make their choice based upon the value of the one face-up card showing in each output tray. The dealer will then deliver the hand to each player face down. In games where participants play against the dealer, the participants will have the benefit of briefly observing one card from the dealer's hand. In games where participants play against each other, each player will have the benefit of briefly observing one card from their opponent's hand. It is believed that entirely new game strategies can evolve from such games as Three-card Poker® and Caribbean Stud® when they are played with face-up orientation and with the choice of output trays.

The face-up orientation mode is achieved when the dealer places the unshuffled cards into the input tray 122 in a face-up orientation. Likewise, the face-down mode is achieved simply by inserting the unshuffled cards into the input tray 122 in a face-down orientation.

In some types of poker games such as 5-card stud, the participants compete against each other. When played with the apparatus herein while in the face-up orientation, each player will choose his/her hand based upon the two face-up cards showing in the two output trays. This choice gives the players the perception of having a player advantage. At the same time, each player gets a temporary view of at least one card in their opponent's hand, which may also be perceived as a player advantage.

In other types of poker games such as 3-card poker or 4-card poker, the participants compete against the dealer's hand. When played with the apparatus herein while in the face-up orientation, each player gets a temporary view of at least one card in the dealer's hand, which may also be perceived as a player advantage and may result in the development of different player strategies.

The unique attributes of the apparatus described herein may lead to the development of other unique games and other game strategies that are heretofore unknown. Such games may or may not be modifications of previously known poker games.

The number of nests, the number of output trays, the capacity of the nests, and the number of cards which constitute each substack may be varied from the description herein without violating the principles of the invention. One of ordinary skill, having designer's choice, may choose to utilize different forms of actuators and transport components as described herein. Other forms of transport components, including cables, gears, chains and other types of belts may be substituted for those described herein. Other types of motors, solenoids and actuators are also logical substitutions. Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A card handling apparatus for preparing playing cards for a card game comprising:

a housing able to stand upon a surface of a casino table or an adjacent stand;

a control panel positioned on an exterior of the housing for programming game parameters and indicating apparatus status;

an input portal consisting of a card receiving cavity for receiving an unshuffled card deck;

a discharge portal consisting of a first output tray and a second output tray, each tray for receiving a play-ready substack;

the two output trays viewable by each of the game players;

each output tray having a sensor for detecting card presence;

a card receiver having a plurality of card storage nests;

a card transport having a card transport path that moves individual cards from the input portal to any one of a randomly chosen card storage nest;

each nest configured to hold one play-ready substack;

the two output trays each configured to hold one play-ready substack simultaneously;

wherein a number of cards discharged to each output tray is programmable;

the card receiver being moved incrementally and bidirectionally to align each randomly chosen nest with the card transport path;

at least one microcontroller responsive to the control panel for directing movement of the cards;

the at least one microcontroller configured to choose either the first output tray or the second output tray for receiving the play-ready substacks from any of the plurality of card storage nests;

the at least one microcontroller configured to discharge a play-ready substack to a vacant output tray; and wherein the at least one microcontroller is configured to maintain play-ready substacks simultaneously in both the first output tray and the second output tray.

2. The card handling apparatus of claim 1 whereupon the card receiver is rotatable, wherein the plurality of card storage nests are radially arranged and rotate about a common axis, each nest having two orifices including an exit orifice and an entrance orifice.

3. The card handling apparatus of claim 2 having a motor that rotates the card receiver amongst the plurality of radially-arranged nests while producing a centrifugal force.

4. The card handling apparatus of claim 3 wherein each card storage nest has at least one movable retainer that retains cards within the rotatable card receiver in opposition to the centrifugal force.

5. The card handling apparatus of claim 4 wherein the play-ready substacks within each card storage nest are aligned by the movable retainer.

6. The card handling apparatus of claim 2 wherein the card handling apparatus moves cards into the card storage nests and out of the card storage nests in the same centrifugal force direction.

7. The card handling apparatus of claim 1 configured to discharge two play-ready substacks simultaneously, including a first substack to the first output tray and a second substack to the second output tray.

8. The card handling apparatus of claim 2 configured to discharge two play-ready substacks simultaneously including a first substack to the first output tray and a second substack to the second output tray.

9. The card handling apparatus of claim 2 wherein the apparatus has at least one direct path operable to convey individual cards directly from the input portal to the discharge portal.

10. The card handling apparatus of claim 2 wherein each play-ready substack is moved to one of the two output trays by inertia.

11. The radially arranged card storage nests of claim 2 wherein each exit orifice is smaller than its entrance orifice.

12. The card handling apparatus of claim 1 wherein the at least one microcontroller is additionally configured to randomly designate, based on user-selection obtained by the touch screen, one of the output trays as a source for distributing a play-ready substack to each player.

13. The touch screen of claim 12 additionally configured to display a number which identifies each randomly chosen output tray when designating one of the output trays as the source for distributing a play-ready substack to each player.

14. The card handling apparatus of claim 4 wherein the movable retainer of each card storage nest is configured to be actuated independently of the others.

15. The card handling apparatus of claim 4 wherein the movable retainer of each card storage nest is configured to be displaced by either a first selector or a second selector.

16. The card handling apparatus of claim 15 wherein the first selector and the second selector are each actuated by a solenoid.

17. The card handling apparatus of claim 15 wherein the first selector and the second selector are each implemented with an electromagnet.

18. The card handling apparatus of claim 15 wherein the first selector and the second selector are each configured to simultaneously displace the movable retainer of a different radially-arranged nest.

19. The card handling apparatus of claim 2 wherein a purging cycle includes discharging cards to both output trays simultaneously.

20. The card handling apparatus of claim 1 wherein the play-ready substacks are discharged to both output trays in a face up orientation.

21. The card handling apparatus of claim 2 wherein the play-ready substacks are discharged to both output trays in a face up orientation.

22. The card handling apparatus of claim 1 wherein the play-ready substacks are discharged to both output trays in a face down orientation.

23. The card handling apparatus of claim 2 wherein the play-ready substacks are discharged to both output trays in a face down orientation.

* * * * *